US005918662A

United States Patent [19]

Tezuka et al.

[11] Patent Number: 5,918,662

[45] Date of Patent: Jul. 6, 1999

[54] METHOD OF CONTROLLING THE OPERATION OF CONTINUOUS CASTING AND APPARATUS THEREFOR

[75] Inventors: Koichi Tezuka; Akio Nagamune; Hiroshi Maeda; Hiroaki Miyahara; Atsushi Ohta; Akira Ohsumi, all of Tokyo, Japan

[73] Assignee: NKK Corporation, Tokyo, Japan

[21] Appl. No.: 08/718,530

[22] PCT Filed: Feb. 28, 1996

[86] PCT No.: PCT/JP96/00458

§ 371 Date: Oct. 8, 1996

§ 102(e) Date: Oct. 8, 1996

[87] PCT Pub. No.: WO96/26800

PCT Pub. Date: Sep. 6, 1996

[30] Foreign Application Priority Data

| | | | |
|---|---|---|---|
| Feb. 28, 1995 | [JP] | Japan | 7-041007 |
| Mar. 1, 1995 | [JP] | Japan | 7-042116 |
| Dec. 18, 1995 | [JP] | Japan | 7-328765 |
| Jan. 31, 1996 | [JP] | Japan | 8-015194 |

[51] Int. Cl.[6] ..... B22D 11/18; B22D 11/20; B22D 11/08; B22D 11/16

[52] U.S. Cl. ..... 164/453; 164/454; 164/483; 164/449.1; 164/450.1; 164/450.5; 164/413

[58] Field of Search ..... 164/453, 454, 164/483, 449.1, 450.1, 450.5, 413; 266/94, 99; 75/387, 375

[56] References Cited

U.S. PATENT DOCUMENTS

| | | | |
|---|---|---|---|
| 4,600,047 | 7/1986 | Matoba et al. | 164/453 |
| 4,771,821 | 9/1988 | Matsushita et al. | 164/453 |
| 4,787,437 | 11/1988 | Kursfeld | 164/453 |
| 5,004,040 | 4/1991 | Pleschiatschnigg et al. | 164/453 |
| 5,311,924 | 5/1994 | Asano et al. | 164/453 |
| 5,409,054 | 4/1995 | Moriceau | 164/453 |
| 5,507,854 | 4/1996 | Yamada et al. | 75/387 |
| 5,633,462 | 5/1997 | Heaslip et al. | 164/453 |

FOREIGN PATENT DOCUMENTS

| | | | |
|---|---|---|---|
| 58-84652 | 5/1983 | Japan . | |
| 61-9104 | 3/1986 | Japan . | |
| 62-57752 | 3/1987 | Japan . | |
| 62-192246 | 8/1987 | Japan | 164/453 |
| 62-270264 | 11/1987 | Japan | 164/453 |
| 2-142659 | 5/1990 | Japan . | |
| 4-118163 | 4/1992 | Japan | 164/453 |
| 5-13746 | 2/1993 | Japan . | |
| 6-238412 | 8/1994 | Japan . | |

*Primary Examiner*—Robert Davis
*Assistant Examiner*—I.-H. Lin
*Attorney, Agent, or Firm*—Ladas & Parry

[57] ABSTRACT

A continuous-casting operation controlling method and apparatus in which: the molten-bath level of molten steel in a mold is detected in a period of from the time point just after the start of injection of the molten steel to the time point when the molten-bath level reaches a molten-bath level for the steady-state operation; and the quantity of discharge of the molten steel is controlled appropriately on the basis of the detected molten-bath level to thereby make it possible to start drawing-out of casting automatically. The molten-bath level is measured continuously by an electrode type molten-bath level meter, so that the molten-bath level ascending rate is obtained on the basis of the change of the molten-bath level. The flow rate of the molten steel discharged from a tundish is adjusted on the basis of the deviation of the molten-bath level ascending rate from a reference rate. When the molten-bath level then reaches a predetermined reference level lower than the molten-bath level for the steady-state operation, drawing-out of casting is started.

8 Claims, 14 Drawing Sheets

CONTROL SYSTEM CONFIGURATION

CONTROL CHART

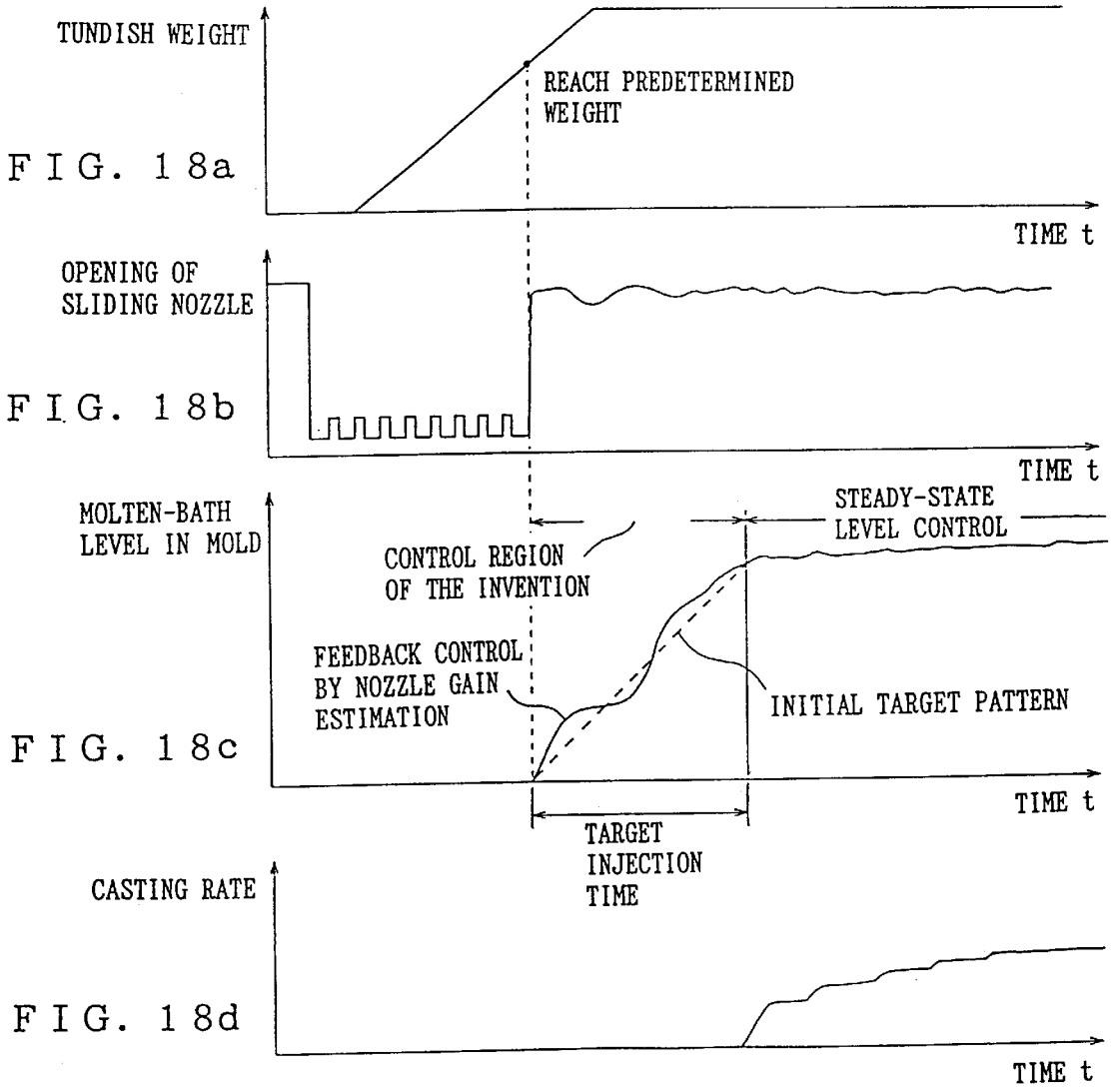
CONTROL CHART

METHOD OF CONTROLLING THE OPERATION OF CONTINUOUS CASTING AND APPARATUS THEREFOR

CROSS-REFERENCE TO RELATED APPLICATION

This application is a 371 of PCT/JP96/00458, filed on Feb. 28, 1996.

TECHNICAL FIELD

The present invention relates to a method of controlling the operation of continuous casting of molten steel and an apparatus therefor, and particularly to automatic start at the initiation of casting.

BACKGROUND ART

In such continuous molten steel casting of this type, various control methods have been heretofore proposed for optimally controlling the time of holding molten steel in a mold before the start of drawing out a dummy bar, for the purpose of attaining appropriate generation of a solidified shell. For example, Japanese Patent Unexamined Publication No. Sho-58-84652 has proposed a control method in which the quantity of molten steel to be injected and the target opening value of a sliding nozzle corresponding thereto are calculated from the depth of molten steel in a tundish on the basis of a predetermined ascending pattern of the molten-bath level in the mold to thereby control the quantity of molten steel to be injected. In this control method, however, the deviation of the molten-bath level with the passage of time from the predetermined molten-bath surface ascending pattern is not feedback-controlled. Accordingly, fluctuation due to the variation of nozzle characteristic and maloperation cannot be covered, so that there arises a mismatch state with respect to the flow rate.

Further, in order to improve the aforementioned control technique, Japanese Patent Unexamined Publication No. Sho-62-84862 has proposed a control method in which the time required for reaching a predetermined intermediate-check molten-bath level is set so that when the intermediate-check molten-bath level is not reached in the predetermined required time, this fact is used as a trigger to increase the opening of a flow rate controller up to a preset emergency processing opening to thereby follow a basic molten-bath level ascending pattern.

Further, Japanese Patent Unexamined Publication No. Sho-62-54562 has proposed a control method in which the molten-bath level ascending pattern is corrected when the molten-bath level ascending pattern is out of place at the intermediate-check level. Further, as the method of controlling the molten-bath level ascending rate, Japanese Patent Unexamined Publication Nos. Sho-62-183951, Hei-1-170568, Hei-2-142659, etc. have proposed various methods in any of which the detection level is grasped by the fact as to whether a predetermined molten-bath level is reached or not, so that feedback information of the detection level is not continuous.

Further, Japanese Patent Unexamined Publication No. Hei-2-142659 has proposed a control method in which a plurality of electrodes having different lengths are disposed so that respective molten-bath levels are detected. In this control method, however, the following disadvantages are pointed out.

(1) The cost of capital investment becomes high.

(2) The influence of the maloperation due to the influence of a splash cannot be removed completely.

(3) Running cost becomes high.

(4) In a billet continuous casting process, it is difficult, from limitation of equipment, to mount a plurality of electrodes in a small sectional area, for example, having a diameter not larger than 170 mm.

As described above, a system in which the ascending rate of the molten-bath level is measured every moment continuously from the time point just after the start of injection to thereby perform feedback control, is not employed in the conventional control methods. There is however some inclusion in molten steel in a tundish, so that the inclusion near the upper portion of the molten steel in the tundish is caught in if the molten-bath level ascending rate just after the start of injection of molten metal is too high. This causes defectives such as cracking of the billet due to the inclusion after casting. There arises a problem that defective percentage becomes high if the molten-bath level ascending rate is set to the optimum value. This problem is remarkable particularly in the case of billet continuous casting by which the molten-bath level ascending rate in the mold with a small section just after the start of injection of molten steel into the mold is high.

Further, in the case where the tundish is re-used as in the case of slab continuous casting, the nozzle gain is changed widely by the influence of slag remaining in the tundish just after the start of casting, so that the discharge flow rate is changed. Accordingly, automatic starting cannot be performed stably without feedback control in the control region. Therefore, the sliding nozzle cannot but be operated manually. In the case of such a manual operation, there is however a tendency of overaction, so that the frequency in generation of the trouble of choking of the nozzle is high.

DISCLOSURE OF THE INVENTION

An object of the present invention is to provide a continuous-casting operation controlling method and apparatus for appropriately controlling the discharge quantity of molten steel in a mold while detecting the molten-bath level of the molten steel in a period of from the time point just after the start of injection of the molten steel to the time point when the molten-bath level of the molten steel reaches a steady-state molten-bath level, so that drawing-out of casting can be started automatically.

a) According to an aspect of the present invention, the continuous-casting operation controlling method comprises, in a period until the molten-bath level of the molten steel reaches molten-bath level for a steady-state operation from just after the molten steel is injected into a mold in continuous casting, the steps of: measuring a molten-bath level of molten steel by an electrode type molten-bath level meter continuously; and starting drawing-out of casting when the molten-bath level reaches a reference level which is lower than the molten-bath level for the steady-state operation.

In the present invention, two electrodes, that is, first and second electrodes of an electrode type molten-bath level meter are inserted vertically in a mold before the start of casting so that the two electrodes come just in front of a dummy bar in the mold. Even in the case where a signal is inputted into the first electrode before the start of casting, the signal is not transmitted to the second electrode because the second electrode is electrically insulated from the first electrode. When molten steel is injected into the mold so that operation is started, the molten steel begins to come into contact with the first and second electrodes so that the signal inputted into the first electrode is transmitted to the second electrode through the molten steel. For example, when a predetermined time is passed after a stopper or sliding nozzle in the tundish is opened fully to start the injection of the molten steel into the mold, the opening of the stopper or sliding nozzle is reduced to a predetermined value. After the start of injection of molten steel, the molten-bath level of the molten steel in the mold ascends gradually. As the level of the molten steel in the mold ascends, the time lag caused by propagation of the signal transmitted between the first and second electrodes through the molten steel is shortened. The molten-bath level of the molten steel in the mold can be measured continuously after the start of injection of the molten steel by measuring the change of the time lag of the signal. When the molten-bath level then reaches a reference level, drawing-out of casting is started. Then, the drawing-out rate and the quantity of injection of the molten steel (the opening of the nozzle in the tundish) are controlled correspondingly to the molten-bath level and the molten-bath level ascending rate to thereby adjust the level of the molten steel in the mold and the molten-bath level ascending rate so that the molten-bath level is converged into a predetermined constant value.

At the point of time when the molten-bath level of the molten steel in the mold reaches a steady-state molten-bath level, the control is shifted to the control of a steady-state operation using the value measured by an electromagnetic induction type level meter. In the general control by using the electromagnetic induction type level meter, the molten steel level in the mold is not measured in a period of from the time point of the start of molten-bath level ascending to the time point of reaching the measurement range of the electromagnetic induction type level meter, that is, the control is performed after the molten steel level ascends to enter the measurement range. Accordingly, the control of the molten-bath level of the molten steel in the mold is delayed correspondingly to the molten-bath level ascending rate in the mold, so that a long time may be required for shifting the operation to the steady-state operation because of the ascending of the molten-bath level to a level not smaller than a target level and the generation of fluctuation in the molten-bath level. In the present invention, however, control in accordance with the molten-bath level of the molten steel in the mold and the molten-bath level ascending rate is performed after the start of molten-bath level ascending to thereby prevent the fluctuation of the molten-bath level, or the like, from arising. Accordingly, the operation can be shifted to the steady-state operation stably in the shortest time.

Further, in the measurement of the molten-bath level according to the present invention, the portions of the electrodes lower than the molten-bath surface of the molten steel are melted at the point of time when the electrodes enter into the molten steel. Accordingly, in the case where the molten-bath surface of the molten steel is fluctuated up and down, it is difficult to detect the signal because the contact between the electrodes is interrupted. With respect to slight fluctuation, however, continuous measurement is performed while adjusting the material for the electrodes and the shape of the electrodes to thereby adjust the melting time after the entrance of the molten steel and keep the electrodes into contact with the molten steel. Further, continuous measurement can be also performed by using long electrodes so that the electrodes are inserted into the mold successively as the electrode material is melted and consumed.

Although the above description has been made upon the case where the electrode type molten-bath level meter has two electrodes, the present invention may be applied to the case where one electrode is used so that the molten-bath level is measured on the basis of the relation between a signal transmitted to the electrode and a signal reflected on the electrode.

b) According to another aspect of the present invention, the continuous-casting operation controlling method stated in the above item a), further comprises, in a period until the molten-bath level of the molten steel reaches the molten-bath level for the steady-state operation from just after the molten steel is injected into the mold in the continuous casting, the steps of: obtaining a molten-bath level ascending rate on the basis of a change of the molten-bath level; and adjusting a flow rate of the molten steel discharged from a tundish on the basis of a deviation of the molten-bath level ascending rate from a reference rate.

In the present invention, the molten-bath level is measured continuously and the molten-bath level ascending rate is calculated on the basis of the change of the measured molten-bath level, for example, in a predetermined period. To eliminate the deviation between the molten-bath level ascending rate and a reference rate, the quantity of correction of the opening of the stopper or sliding nozzle is obtained and an operating instruction is outputted to the stopper or sliding nozzle to thereby perform feedback control with a predetermined period. When the molten-bath level then reaches the reference level, drawing-out of casting is started. Incidentally, the aforementioned reference rate is the optimum molten-bath level ascending rate at which no inclusion is generated. The reference rate is obtained in advance in accordance with the operating condition for every billet diameter. Although PI control (proportion+integration control) is used as feedback control, for example, in an embodiment which will be described later, another method may be used.

As described above, according to the present invention, the quantity of molten steel discharged from the tundish is designed to be adjusted on the basis of the molten-bath level ascending rate, so that the molten-bath level ascending rate of the molten steel in the mold is controlled appropriately. Further, as the result of the appropriate control of the molten-bath level ascending rate, there is obtained an effect that the percentage of generation of failure billets after casting due to the entrance of the inclusion is reduced by about 20%. Further, like the conventional technique, not only the optimal production of a solidified shell can be achieved but also the prevention of the occurrence of breaking-out can be achieved. Furthermore, various phenomena which occur in the initial stage of casting, such as sudden ascending of the molten-bath surface caused by the separation of stopper refractories, overflowing caused by the delay of the stopper operating action, or the like, can be prevented in advance.

c) According to another aspect of the present invention, the continuous-casting operation controlling method stated in the above item a), further comprises, in a period until the molten-bath level of the molten steel reaches the steady-state molten-bath level for the steady-state operation from just after the molten steel is injected into the mold in the continuous casting, the steps of: measuring a molten steel head in a tundish; calculating an estimated nozzle gain value on the basis of the molten-bath level, the molten steel head and an opening of a stopper or sliding nozzle at that time; calculating a target discharge quantity of the molten steel on the basis of the molten-bath level to satisfy a target injection time which is set in advance; calculating the opening of the stopper or sliding nozzle on the basis of the estimated nozzle gain value and the target discharge quantity; and adjusting a flow rate of the molten steel discharged from the tundish by operating the opening of the stopper or sliding nozzle on the basis of the calculated opening; wherein the series of steps is repeated every predetermined arithmetic operation period.

In the present invention, when the molten-bath level of molten steel in the mold ascends, not only the molten-bath level of the molten steel in the mold is measured continuously by the electrode type molten-bath level meter but also the molten steel head in the tundish is measured. For example, the ascending value of the molten-bath level from the preceding period is obtained in every arithmetic operation period, so that the current actual discharge quantity is obtained on the basis of the ascending value. Then, the estimated value of the current nozzle gain is calculated on the basis of the actual discharge quantity, the molten steel head and the opening of the stopper or sliding nozzle in the tundish. Then, the target discharge quantity in this period is obtained on the basis of the current molten-bath level and the time left up to the target injection time, so that the opening of the stopper or sliding nozzle in this period, for example, the opening area thereof, is obtained on the basis of the target discharge quantity, the estimated nozzle gain value and the current molten steel head. Feedback control is performed by operating the stopper or sliding nozzle on the basis of this result to thereby optimally control the flow rate of the molten steel discharged from the tundish particularly with respect to the wide fluctuation of the nozzle gain caused by the influence of slag just after the start of casting re-using the tundish, so that not only the target injection time can be satisfied but also trouble such as choking of the nozzle can be prevented.

Further, according to the present invention, even in the case where the discharge flow rate is fluctuated by the wide fluctuation of the nozzle gain caused by the influence of slag remaining in the tundish particularly when the tundish is re-used, the discharge quantity is controlled optimally to obtain an effect that trouble such as choking of the nozzle, leaking from a seal, overflowing, etc. at the time of re-use of the tundish is reduced to the frequency of ⅓ in comparison with the case where the present invention is not yet applied.

d) According to a further aspect of the present invention, the continuous-casting operation controlling method stated in the above item (a~c) further comprises the steps of: obtaining a molten-bath level ascending rate on the basis of a change of the molten-bath level after start of the drawing-out of casting; controlling the molten-bath level of the molten steel in the mold by adjusting the rate of drawing-out of casting and the quantity of injection of the molten steel discharged from the tundish on the basis of the molten-bath level and the molten-bath level ascending rate; and starting the steady-state operation when the molten-bath level reaches the level for the steady-state operation.

In the present invention, the drawing-out rate and the quantity of molten steel to be injected (the opening of the nozzle in the tundish) are controlled in accordance with the molten-bath level and the molten-bath level ascending rate after the start of drawing-out of a billet, so that the molten-bath level and the molten-bath level ascending rate are adjusted to converge the molten-bath level of the molten steel into a predetermined constant value.

e) According to a further aspect of the present invention, the continuous-casting operation controlling method stated in the above item (a~d) further comprises the steps of: calibrating a measured value of an electromagnetic induction type level meter on the basis of the molten-bath level of the molten steel in the mold measured by the electrode type molten-bath level meter; and controlling the molten-bath level of the molten steel in the mold on the basis of the measured value of the electromagnetic induction type level meter after the molten-bath level reaches the level for the steady-state operation.

In the present invention, an electromagnetic induction type level meter and electrodes are disposed in the mold and the molten-bath level in the mold is measured by the electrode type molten-bath level meter after the start of casting (the start of injection of molten steel). At the point of time when the molten-bath level of molten steel in the mold reaches the measurement span of the electromagnetic induction type level meter, the value measured by the electromagnetic induction type level meter is calibrated on the basis of the value measured by the electrode type molten-bath level meter to thereby prevent error, which is caused by temperature drift, or the like, from occurring in the value measured by the electromagnetic induction type level meter, and the absolute value of the measurement value of the electromagnetic induction type level meter is calibrated. After the operation is shifted to the steady-state operation, the drawing-out rate and the opening of the nozzle in the tundish (TD) are adjusted on the basis of the value measured by the electromagnetic induction type level meter so that accurate control is performed in the absolute value of the molten-bath level of the molten steel in the mold.

f) According to a further aspect of the present invention, the continuous-casting operation controlling method stated in the above item (a~e) further comprises the steps of: holding electrodes of the electrode type molten-bath level meter above the molten-bath surface of the molten steel after the molten-bath level reaches the steady-state molten-bath level to start the steady-state operation; detecting the contract between the molten steel and the electrodes; and adjusting the opening of a tundish nozzle on the basis of the detection of the contact to prevent the molten steel from overflowing out of the mold.

In the present invention, in the steady-state operation of continuous casting, electrodes are disposed in arbitrary positions which are higher than the steady-state molten-bath level in the mold. Further, the contact between the molten steel and the electrodes is always monitored. By this monitoring, even in the case where the molten-bath level of molten steel in the mold ascends abnormally because of the occurrence of the control failure which is caused by the failure of the electromagnetic induction type level meter in the steady-state operation, or the like, the abnormal ascending of the molten-bath level and the molten-bath level ascending rate can be detected by the detection of the contact between the electrodes and the molten steel. By this detection of these values, the drawing-out rate or the molten steel injection quantity is adjusted to thereby prevent overflowing.

g) According to a further aspect of the present invention, in the continuous-casting operation controlling method stated in the above item (a~f), a member capable of melting at a rate nearly equal to the molten-bath level ascending rate of the molten steel at the time of the start of casting is used as each of the electrodes of the electrode type molten-bath level meter.

In the present invention, the electrodes are melted at a rate nearly equal to the ascending rate of the molten-bath level of molten steel at the time of the start of casting, so that harmful effects are avoided both in the case where melting is too late and in the case where melting is too fast. That is, in the case where melting is too late, the electrodes exist continuously up to the lower portion of the mold even at the time of the start of drawing-out. Accordingly, the electrodes are caught in the solidified shell at the time of the start of drawing-out and the electrodes are drawn out of the electrode holder with the start of drawing-out, so that it becomes impossible to perform measurement. Contrariwise in the case where melting is too fast, the contact between the molten steel and the electrodes is broken off when the molten-bath level is fluctuated. As a result, there arises a situation in which it is impossible to perform measurement. In the present invention, however, harmful effects both in the case of too late melting and in the case of too fast melting are avoided by setting the melting rate of the electrodes appropriately, so that it is possible to measure the molten-bath level continuously even in a small section mold such as a billet.

h) According to a further aspect of the present invention, the continuous-casting operation controlling apparatus comprises: an electrode type molten-bath level meter including electrodes to be inserted into molten steel in a mold, supplying a first pseudo-random signal to the electrodes, calculating a first multiplication value by multiplying the first pseudo-random signal by a second pseudo-random signal which has the same pattern as the first pseudo-random signal but which is slightly different in frequency from the first pseudo-random signal, calculating a second multiplication value by multiplying the second pseudo-random signal by a signal obtained through the electrodes, integrating the first and second multiplication values respectively, measuring a molten-bath level on the basis of a time difference between maximum correlation values generated in time-series patterns of the integrated values respectively, and calculating a molten-bath level ascending rate on the basis of a change of the molten-bath level; and a casting controller for controlling an opening of a stopper or sliding nozzle in a tundish on the basis of a deviation of the molten-bath level ascending rate from a reference rate to adjust a flow rate of the molten steel discharged from the tundish and start drawing-out of casting when the molten-bath level reaches a reference level which is lower than the molten-bath level for the steady-state operation.

In the present invention, as described above, the molten-bath level is measured continuously by the electrode type molten-bath level meter in a period of from the time point just after the injection of molten steel into the mold in continuous casting to the tie point when the molten-bath level reaches a steady-state level, and the molten-bath level ascending rate is calculated, for example, in a predetermined period on the basis of the change of the molten-bath level. Further, in order to eliminate the deviation of the molten-bath level ascending rate from a reference rate, the quantity of correction of the opening of the stopper or sliding nozzle is obtained and an operating instruction is issued to the stopper or sliding nozzle to perform feedback control with a predetermined period. When the molten-bath level reaches the reference level, drawing-out of casting is started.

i) According to a further aspect of the present invention, the continuous-casting operation controlling apparatus comprises: an electrode type molten-bath level meter including electrodes to be inserted into molten steel in a mold, supplying a first pseudo-random signal to the electrodes, calculating a first multiplication value by multiplying the first pseudo-random signal by a second pseudo-random signal which has the same pattern as the first pseudo-random signal but which is slightly different in frequency from the first pseudo-random signal, calculating a second multiplication value by multiplying the second pseudo-random signal by a signal obtained through the electrodes, integrating the first and second multiplication values respectively, measuring a molten-bath level on the basis of a time difference between maximum correlation values generated in time-series patterns of the integrated values respectively; means for measuring a molten steel head in a tundish; and a casting controller for calculating an estimated nozzle gain value on the basis of the molten-bath level, the molten steel head and an opening of a stopper or sliding nozzle at that time, calculating a target discharge quantity of the molten steel on the basis of the molten-bath level to satisfy a target injection time which is set in advance, calculating the opening of the stopper or sliding nozzle on the basis of the estimated nozzle gain value and the target discharge quantity, adjusting a flow rate of the molten steel discharged from the tundish by operating the opening of the stopper or sliding nozzle on the basis of the calculated opening, repeating the above-mentioned processing in every operation period, and starting drawing-out of casting when the molten-bath level reaches a reference level which is lower than the molten-bath level for the steady-state operation.

In the present invention, as described above, the opening of the stopper or sliding nozzle in this period, for example, the opening area of the stopper or sliding nozzle is obtained on the basis of the target discharge quantity, the estimated nozzle gain value and the current molten steel head. The stopper or sliding nozzle is operated on the basis of the result to perform feedback control. Accordingly, particularly, not only the target injection time can be satisfied but also trouble such as choking of the nozzle, or the like, can be prevented.

j) In the continuous-casting operation controlling apparatus according to the first aspect of the present invention, the electrode type molten-bath level meter includes: a first pseudo-random signal generating means for generating a first pseudo-random signal; a second pseudo-random signal generating means for generating a second pseudo-random signal which has the same pattern as the first pseudo-random signal but which is slightly different in frequency from the first pseudo-random signal; a first electrode connected to the first pseudo-random signal generating means and inserted into the molten steel; a second electrode inserted into the molten steel; a first multiplier for multiplying an output of the first pseudo-random signal generating means by an output of the second pseudo-random signal generating means to thereby generate a first multiplication value; a second multiplier connected to the second electrode for multiplying an output of the second electrode by the output of the second pseudo-random signal generating means to thereby generate a second multiplication value; a first integrator for integrating the first multiplication value to thereby generate a first integral value; a second integrator for integrating the second multiplication value to thereby generate a second integral value; and an arithmetic operation means for measuring the molten-bath level on the basis of a time difference between maximum correlation values generated in time-series patterns of the first and second integral values respectively, and calculating a molten-bath level ascending rate on the basis of a change of the molten-bath level.

The operation of the aforementioned electrode type molten-bath level meter will be described below. In the electrode type molten-bath level meter, the first pseudo-random signal and the second pseudo-random signal have the same pattern but slightly different frequencies. The time-series pattern of the first multiplication value takes a maximum value, that is, the multiplication value exhibits the maximum correlation value, when pulses in respective periods of the first and second pseudo-random signals coincide with each other. The maximum value is generated with the period T.

The period T is given by the following expression:

$$T=k/\Delta f \quad (1)$$

in which k is a constant showing the number of bits (the number of clocks) constituting one period of each of the first and second pseudo-random signals M1 and M2. Δf is the difference between the clock frequency f1 of one bit of M1 and the clock frequency f2 of one bit of M2 and is given by the following expression.

$$\Delta f = f1 - f2 \quad (2)$$

Also in the time-series pattern of the second multiplication value, the maximum value is generated with the period T. Because the first pseudo-random signal M1 passes through the first electrode, the molten steel and the second electrode, the first pseudo-random signal M1 is delayed by the time Td from the second pseudo-random signal M2. Accordingly, the maximum value of the first multiplication value is delayed by the time X from the maximum value of the second multiplication value as shown in FIG. 9.

X is given by the following expression.

$$X = (Td/\Delta t) \times P2 \quad (3)$$

$$\Delta t = P2 - P1 \quad (4)$$

Here, P1 is the period of M1, and P2 is the period of M2.

Because, in this occasion, Td changes correspondingly to the displacement of the molten-bath level of the molten steel, the displacement of the molten-bath level of the molten steel can be obtained if X is measured to calculate Td on the basis of the expression (3). Contrariwise if the displacement of the level is known, the reference position can be determined and the distance from the reference position to the level can be also obtained. If, in the expression (3), the value of Δt is selected to be smaller than Td and the value of P2 is selected to be large, the value of X can be measured by enlarging the value of Td by P2/Δt times. Accordingly, X can be measured accurately. Further, because, in the measurement according to this method, the signal propagates in the electrodes and molten steel and such a reflection method used in the conventional case is not used, the ratio of S/N is large so that the molten-bath level of the molten steel can be measured accurately without any influence of multiple-reflection. Accordingly, the molten-bath level ascending rate can be also measured accurately.

Although the above description has been made upon the case where the electrode type molten-bath level meter has two electrodes (first and second electrodes), the molten-bath level may be measured by transmitting a pseudo-random signal to one electrode and separating and picking up the reflected wave of the signal from the input signal.

BRIEF DESCRIPTION OF THE DRAWINGS

FIGS. 18(*a*)–18(*d*) are a timing chart of the continuous-casting control depicted in FIG. 17.

BEST MODE FOR CARRYING OUT THE INVENTION

Embodiment 1

Figure 1:
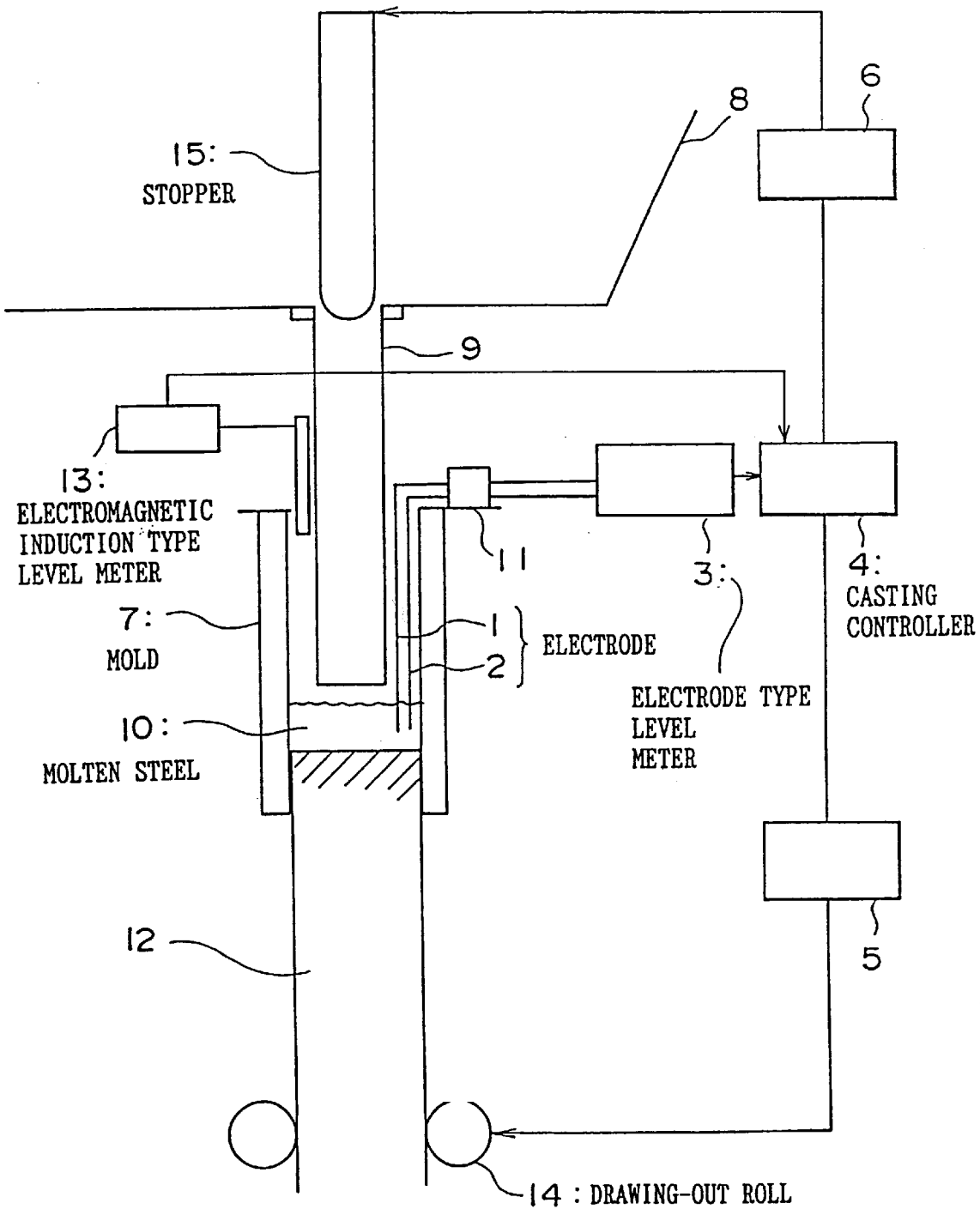
FIG. 1 is a block diagram showing the configuration of a continuous-casting operation controlling apparatus according to an embodiment of the present invention and related equipment.

FIG. 1 is a block diagram showing the configuration of a continuous-casting operation controlling apparatus according to an embodiment of the present invention and related equipment. In FIG. 1, the reference numerals 1 and 2 designate first and second electrodes, respectively; 3, an electrode type level meter; 4, a casting controller; 5, a drawing-out rate controller; 6, a nozzle opening adjuster; 7, a mold; 8, a tundish; 9, a nozzle; 10, molten steel; 11, an electrode holder; 12, a dummy bar; and 13, an electromagnetic induction type (eddy-current type) level meter. In this embodiment, the two electrodes 1 and 2 vertically inserted into the continuous-casting mold 7 are disposed so as to be held by the electrode holder 11 disposed in the upper portion of the mold 7. Although here is shown the case where respective ends of the electrodes 1 and 2 are located just before the dummy bar 12 in the mold, there is no obstacle to measurement even in the case where the respective ends of the electrodes 1 and 2 touch the dummy bar 12. Further, an SUS pipe (diameter: 3 mm, thickness: 0.1 mm) is used as each of the electrodes 1 and 2, and the distance between the electrodes is selected to be 30 mm.

The electrode type level meter 3 inputs a pseudo-random signal generated therein into the first electrode 1 through a coaxial cable and detects the pseudo-random signal transmitted to the second electrode 2 through molten steel 10 in the mold 7. Further, the electrode type level meter 3 calculates the molten-bath level of molten steel in the mold on the basis of the change of the time lag of the detected pseudo-random signal and the transmission rate of the signal and further calculates the ascending rate of the molten-bath level of molten steel in the mold on the basis of the change quantity per unit time, of the molten-bath level of molten steel.

Figure 2:
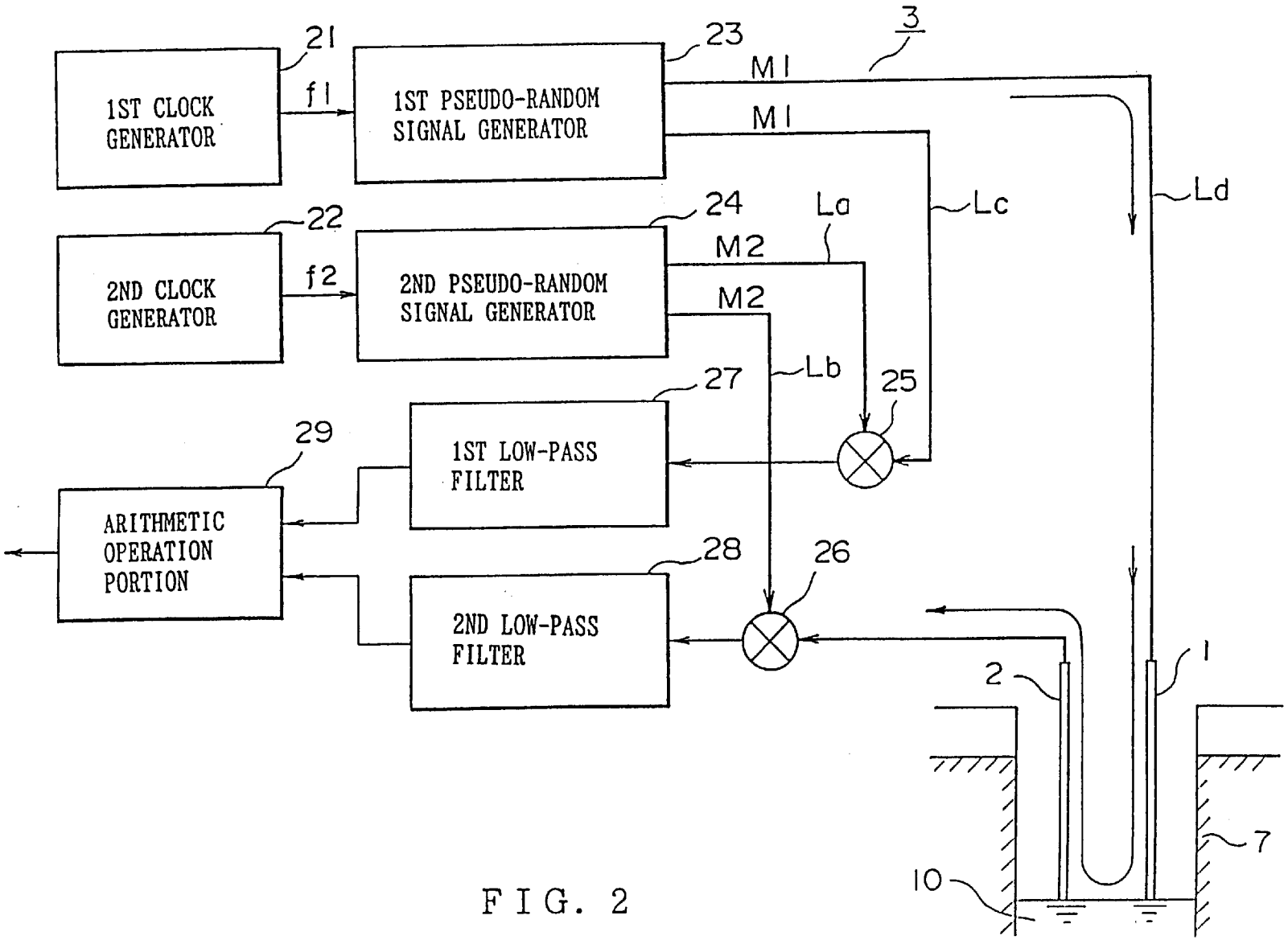
FIG. 2 is a block diagram showing the configuration of the electrode type level meter depicted in FIG. 1.

FIG. 2 is a block diagram showing the detailed configuration of the electrode type level meter 3. In the electrode type level meter 3, a first clock generator 21 generates a frequency of a value f1 per clock and a second clock generator 22 generates a frequency of a value f2 per clock which is slightly smaller than the frequency of the value f1. A first pseudo-random signal generator 23 generates a first pseudo-random signal M1 of a period P1. A second pseudo-random signal generator 24 generates a second pseudo-random signal M2 of the same pattern as the first pseudo-random signal M1 but of a period P2 slightly different from the period P1. The first pseudo-random signal M1 is delivered to the first electrode 1. Then, a signal obtained through the second electrode 2 is inputted to a multiplier 26. A first multiplier 25 multiplies M1 obtained from the first pseudo-random signal generator 23 through a transmission line Lc by M2 obtained from the second pseudo-random signal generator 24 through a transmission line La. A second multiplier 26 multiplies M1 obtained from the first pseudo-random signal generator 23 through a transmission line Ld by M2 obtained from the second pseudo-random signal generator 24 through a transmission line Lb.

A first low-pass filter 27 removes high-frequency components from the output of the first multiplier 25 and outputs as one period a time-series pattern having an interval between the maximum correlation values. Similarly, a second low-pass filter 28 also removes high-frequency components from the output of the second multiplier 26 and outputs as one period a time-series pattern having an interval between the maximum correlation values. An arithmetic operation portion 29 calculates the molten-bath level of molten steel on the basis of the time difference between the maximum correlation values of the time-series patterns of the first and second low-pass filters 27 and 28. The molten-bath level of molten steel, obtained in the arithmetic operation portion 29, is outputted to the casting controller 4. Incidentally, in the aforementioned transmission lines, the first and second electrodes 1 and 2 partly inserted into the molten steel 10 in the mold 7 are provided so as to be electrically connected to each other through the molten steel 10.

Figure 3:
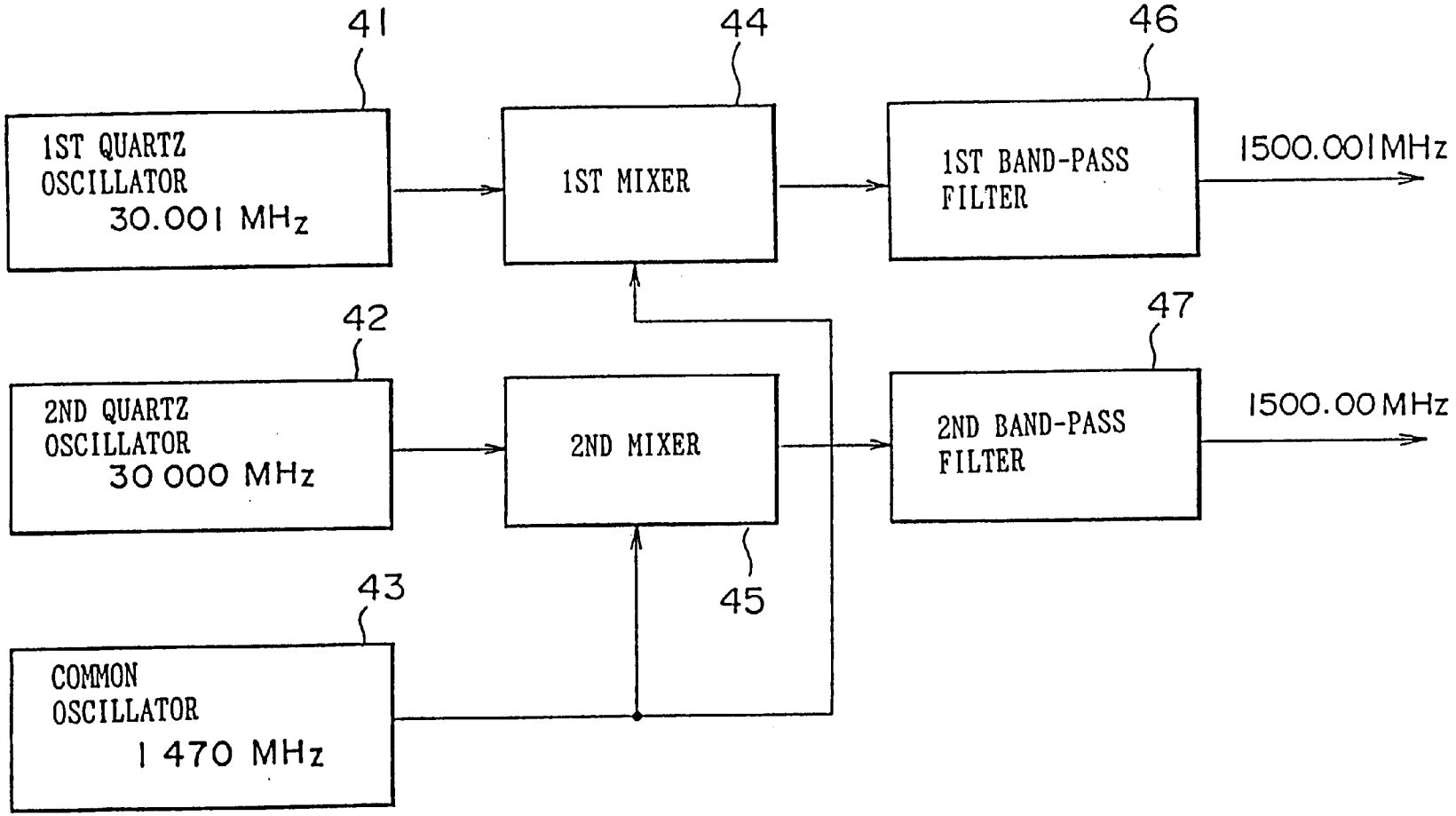
FIG. 3 is a block diagram showing the configuration of the clock generator depicted in FIG. 2.

FIG. 3 is a diagram showing the configuration of the first and second clock generators 21 and 22. A first quartz oscillator 41 is a quartz oscillator of frequency fa, for example, 30.001 MHz, a second quartz oscillator 42 is a quartz oscillator of frequency fb, for example, 30.000 MHz, and a common oscillator 43 is an oscillator of frequency fc, for example, 1470 MHz. A first mixer 44 which is constituted, for example, by a balanced modulator, or the like, is a mixer for outputting a signal of fc±fa and a second mixer 45 is a mixer for outputting a signal of fc±fb. A first band-pass filter 46 passes fc±fa selected from the output of the first mixer 44 and a second band-pass filter 47 passes fc±fb selected from the output of the second mixer 45.

The signal of 30.001 MHz outputted from the first quart oscillator 41 and the signal of 1470 MHz outputted from the common oscillator 43 are mixed by the first mixer 44, so that two signals of 1500.001 MHz and 1439.999 MHz are outputted from the first mixer 44. Of these signals, the signal of 1500.001 MHz passes through the first band-pass filter 46 so as to be outputted as a first clock frequency f1. Similarly, the signal of 30.000 MHz outputted from the second quartz oscillator 42 and the signal of 1470 MHz outputted from the common oscillator 43 are mixed by the second mixer 45, so that two signals of 1500.000 MHz and 1440 MHz are outputted from the second mixer 45. The signal of 15000.000 MHz passes through the second band-pass filter 47 so as to be outputted as a second clock frequency f2. By this configuration, the difference between the frequencies f1 and f2 is kept to be 1 KHz accurately.

Because the difference of 1 KHz is already provided between the first and second quartz oscillators 41 and 42 equivalent to local oscillators and because the difference between the frequencies outputted from the first and second mixers 44 and 45 is large so as to be 60 MHz, the first and second band-pass filters 46 and 47 are not required so sharp characteristic. Accordingly, the first and second band-pass filters 46 and 47 can be realized by general filters such as SAW filters or quartz filters.

Figure 4:
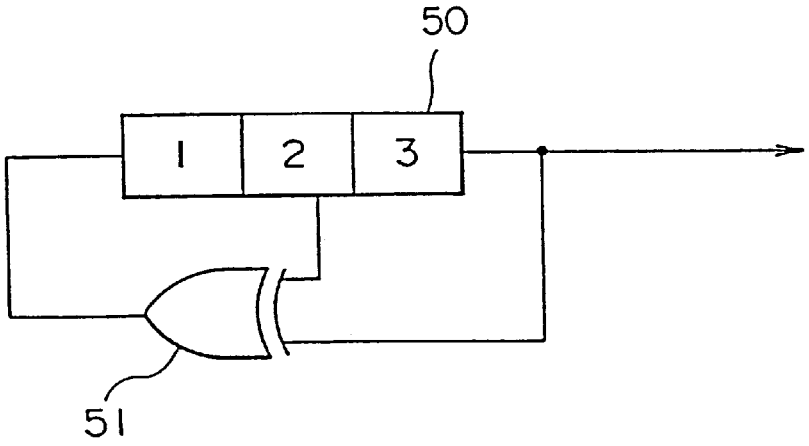
FIG. 4 is a circuit diagram showing an example of the pseudo-random signal (M-series signal) generating circuit depicted in FIG. 2.

FIG. 4 is a diagram for explaining the configuration of the first and second pseudo-random signal generators 23 and 24. FIG. 4 is a diagram showing the configuration of a three-bit M-series signal generator. Although the case of 3 bits is shown in FIG. 4 for simplification of explanation, a shift register, or the like, having a larger number of bits, for example, 7 bits may be used. The M-series signal generator is composed of a shift register 50 constituted by flip-flop circuits synchronized with a clock signal, and an exclusive OR circuit 51 which is supplied with the output signal of the final stage of the shift register 50 and the output signal of the preceding stage thereof and which supplies an output to the first stage.

Figure 5:
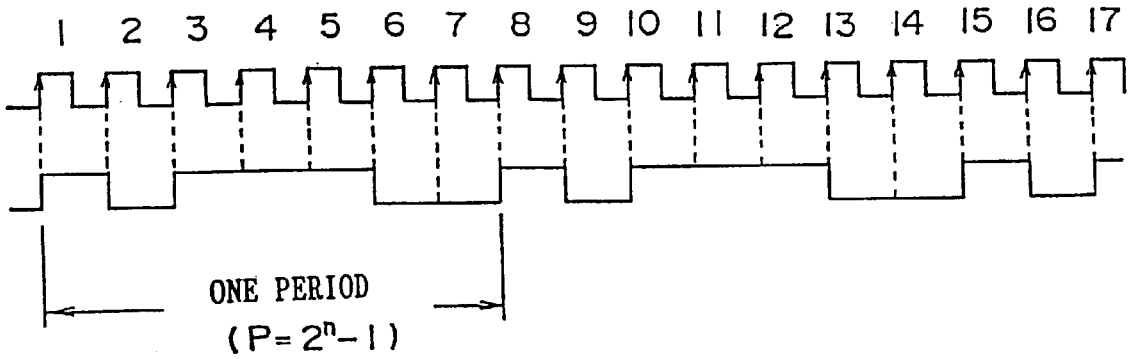
FIG. 5 is a timing chart showing the pseudo-random signal generated by the three-stage shift register depicted in FIG. 4.

FIG. 5 is a timing chart showing a pseudo-random signal (M-series signal) in the case where the three-stage shift register shown in FIG. 4 is used. The number of clocks (the number of bits) in one period is given by $P=2^n-1$ when the number of stages is n. In the case of such a three-stage shift register, P=7 for n=3 is given. When the one-bit clock frequency of the first pseudo-random signal M1 generated from the first pseudo-random signal generator 23 shown in FIG. 4 is represented by f1 and the one-bit clock frequency of the second pseudo-random signal M2 generated from the second pseudo-random frequency generator 24 is represented by f2, the period P1 of M1 and the period P2 of M2 are given by the following expression.

$$P1=(2^n-1)/f1,\ P2=(2^n-1)/f2 \tag{5}$$

The time difference Δt in one period between the pseudo-random signals M1 and M2 is given by the following expression:

$$\Delta t=P2-P1=(2^n-1)(f1-f2)/(f1\cdot f2) \tag{6}$$

in which f1 and f2 satisfy the relation f1>f2. Assuming now the case of f1=1500.001 MHz, f2=1500.000 MHz and a 7-stage shift register (n=7) as a specific example, then P1 and P2 are given as follows.

$$\begin{aligned} P1 &= (2^n-1)/f1 \\ &= (2^7-1)/1500.001\times 10^6 \\ &= 84666.61022\ \text{(psec)} \end{aligned}$$

-continued $$P2 = (2^n - 1)/f2$$
$$= (2^7 - 1)/1500.001 \times 10^6$$
$$= 84666.66667 \text{ (psec)}$$

Further, the difference Δt in one period is obtained as a very small value by the expression (6) as follows.

$$\Delta t = P2 - P1 = 0.0565 \text{ (psec)}$$

Figure 6A:
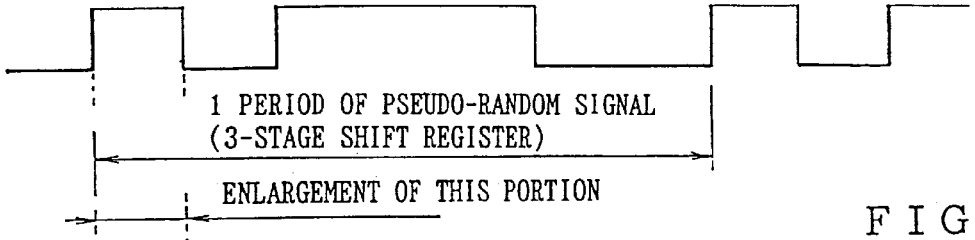
FIGS. 6(*a*)–6(*c*) are a timing chart for explaining the output of a correlation value.
Figure 6B:
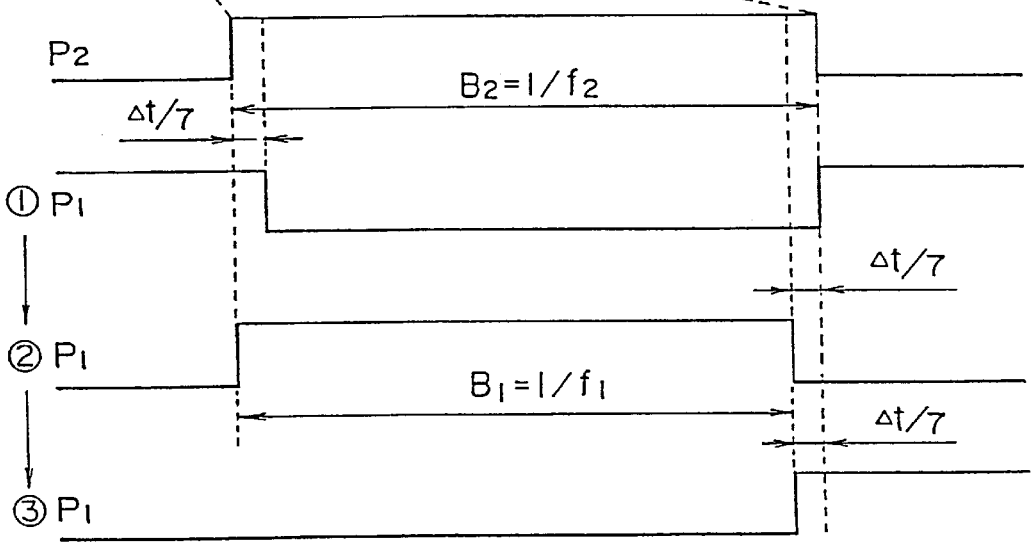
Figure 6C:
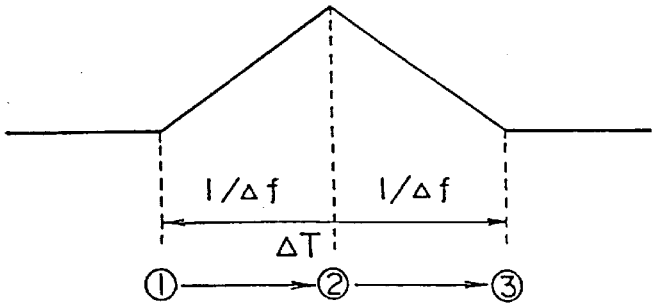

FIGS. 6(*a*), 6(*b*) and 6(*c*) are diagrams for explaining the correlation values obtained by the multipliers 25 and 26. FIG. 6(*b*) is an enlarged diagram of the one-period pseudo-random signals M1 and M2 in the three-stage shift register shown in FIG. 4 and the one-bit portions thereof. FIG. 6(*b*) shows a process in which the signals M1 and M2 become coincident from a state in which the first one bits of M1 and M2 are shifted by one bit and then the signals M1 and M2 become shifted by one bit again. FIG. 6(*c*) shows correlation values in this process. In FIG. 6(*b*), one period P2 of the signal M2 and one period P1 of the signal M1 are shifted by Δt as represented by the expression (6) and each of the periods P1 and P2 is composed of 7 bits. Accordingly, there is a difference of Δt/7 at the first bit in one period and there is a difference of Δt at the final bit, that is, the seventh bit. In the drawing, the symbol ① shows the case where M1 and M2 are shifted by one bit, the symbol ② shows the case where M1 and M2 are most coincident with each other, and the symbol ③ shows the case where M1 and M2 becomes shifted by one bit again. FIG. 6(*c*) is a graph expressed by taking the size of the correlation values corresponding to the cases ① to ③ of FIG. 6(*a*) as the ordinate and a time axis as the abscissa. This expresses the output of the low-pass filters 27 and 28 shown in FIG. 2, so that the value at the vertex of a triangle is the maximum correlation value.

The pseudo-random signals M1 and M2 correlate with each other when the phase of the period P1 coincides with the phase of the period P2. That is, there is no correlation when the shift between the phase of P1 and the phase of P2 is not smaller than one bit. Therefore, when the time per bit of M2 is B2, the timeΔT in which M1 and M2 correlate with each other is given by the following expression:

$$\Delta T = 2(B2/\Delta t) \times P1 = 2(1/\Delta f) \quad (7)$$

in which B2=1/f2.

B2/Δt shows the number of periods P1 of M1 which shifts by one bit. The time corresponding to this number of periods P1 is obtained by multiplying by P1. Because the shift of one bit exists in the front and rear, the time is further doubled. Then, the time (correlation period), which is required for obtaining correlation again after correlation is once obtained, is obtained.

Figure 7:
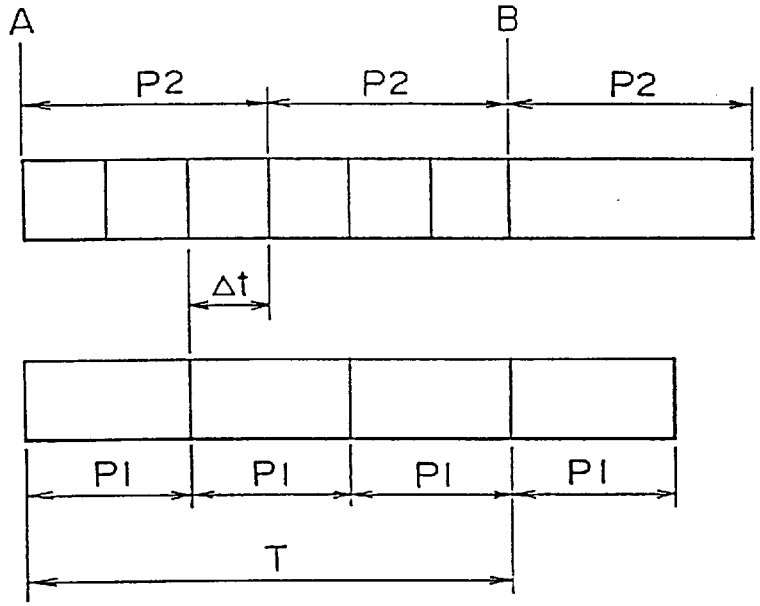
FIG. 7 is a timing chart for explaining a method of calculating a correlation period T.

FIG. 7 is a timing chart showing the change of the phase of the period P1 relative to the period P2. For simplification, FIG. 7 shows the case where the value of Δt is made relatively large to the values of P1 and P2. If P1 is repeated from the position A by the times the number of which is identical of the number of Δt contained in P2, the position B is reached where the relation between P1 and P2 is the same as in the position A, as shown in FIG. 7. Accordingly, T is given by the following expression.

$$T = (P2/\Delta t) \times P1 \quad (8)$$
$$= (P2/(P2 - P1)) \times P1$$
$$= (2^n - 1)/\Delta f$$

The expression (8) shows the expression (1) described preliminarily.

Figure 8:
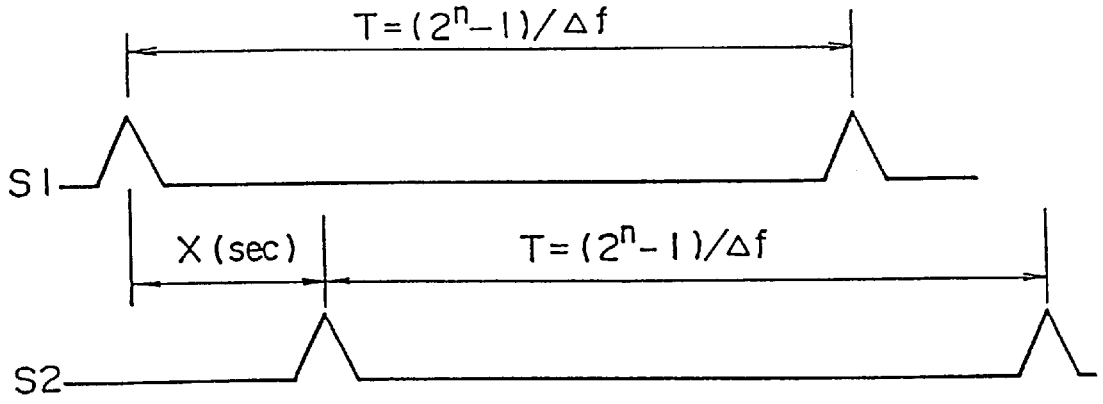
FIG. 8 is a timing chart showing the output S1 of a first low-pass filter and the output S2 of a second low-pass filter.

FIG. 8 is a timing chart showing the outputs of the first and second low-pass filters 27 and 28 depicted in FIG. 2. S1 shows the output of the first low-pass filter 27 and S2 shows the output of the second low-pass filter 28. In each of S1 and S2, maximum correlation values appear with the correlation period T. Incidentally, assuming that the transmission lines La to Ld in FIG. 2 also represent the lengths of the respective lines, then the transmission line La represents the transmission distance from the second pseudo-random signal generator 24 to the first multiplier 25, the transmission line Lb represents the transmission distance from the second pseudo-random signal generator 24 to the second multiplier 26, the transmission line Lc represents the transmission distance from the first pseudo-random signal generator 23 to the first multiplier 25, and the transmission line Ld represents the transmission distance from the first pseudo-random signal generator 23 to the second multiplier 26 via the first and second electrodes 4 and 5. In the case of La=Lb and Lc=Ld, the phase difference X between S1 and S2 is zero. In the case of Lc≠Ld, there arises a phase difference X corresponding to the difference between Lc and Ld.

Figure 9:
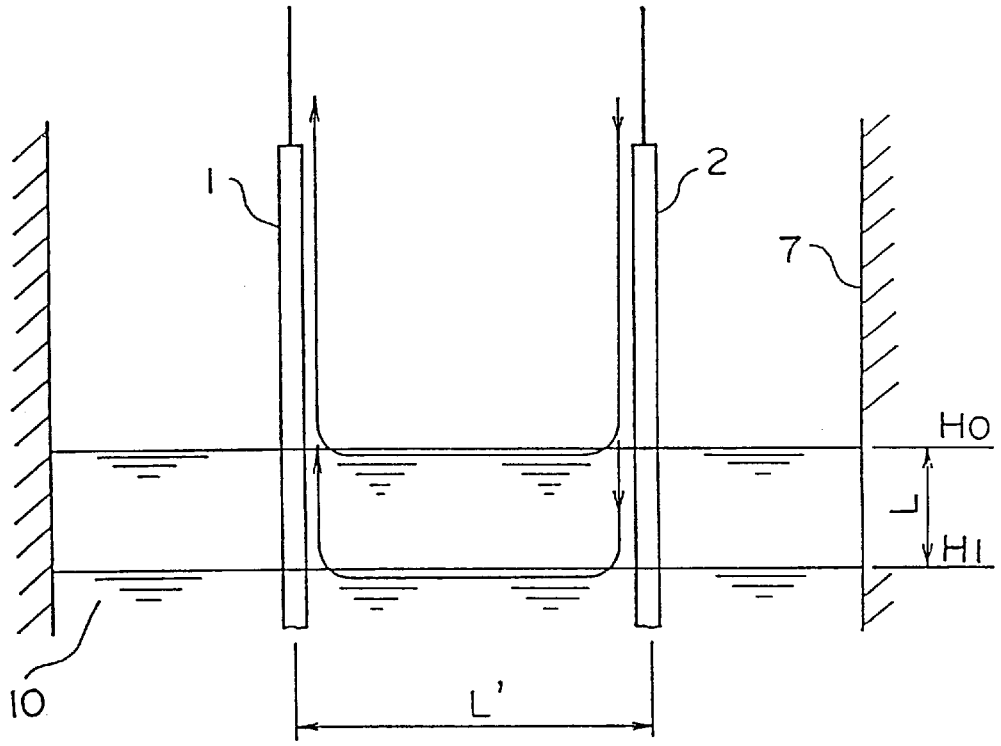
FIG. 9 is a diagram for explaining the level of molten metal and signal transmission distance.

FIG. 9 is a diagram for explaining the change of Ld−Lc in the case where the molten-bath level of molten steel changes.

Assuming that the level changes by L in the following condition $Ld - Lc = L'$ when the level is H0, and $Ld - Lc = 2L + L'$ when the level is H1, the signal M1 transmitted from the first pseudo-random signal generator 23 to the multiplier 26 is delayed, from the signal M1 transmitted to the multiplier 25, by the time Td (delay time) given by the following expression.

$$Td = (2L + L')/V \quad (9)$$

in which V is $3 \times 10^8$ m/sec (light velocity) as the velocity of the signal M1 propagating in the electrodes and the molten steel.

Figure 10:
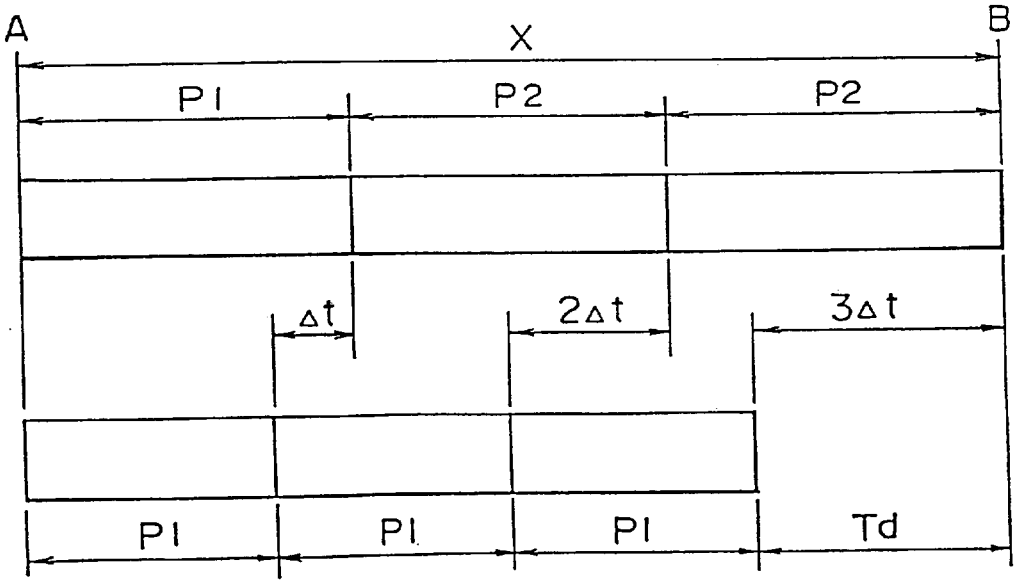
FIG. 10 is an explanatory diagram for calculation of phase difference X.

FIG. 10 is a timing chart showing the relation between the delay time Td and the phase difference X. In the positions A and B, the phase of the period P2 coincides with the phase of the period P1. In the position A, the maximum correlation value of the output S1 is generated. In the position B, the maximum correlation value of the output S2 is generated. Because n periods P2 and n periods P1 are contained in the phase difference X and because the difference between the n periods P2 and the n periods P1 is expressed by nΔt which is equal to the delay time Td, the following expression holds.

$$Td = n\Delta t \quad (10)$$

Because n is a value satisfying n=X/P2, the following expression holds.

$$X = (Td/\Delta t)P2 \quad (11)$$
$$= Td \times f1/\Delta f$$
$$= ((2L + L') \times f1)/(V \times \Delta f) \quad (12)$$

This expression (11) shows the expression (3) described preliminarily.

By using the expression (12), the molten-bath level of the molten steel is obtained as follows. First, the reference level H0 is set. When the level displacement L in the level H0 is set to be zero and the phase difference X0 in the level H0 is obtained, L' can be obtained from the expression (12). When the phase difference X1 in the level H1 lower by L than the reference level H0 is obtained, L can be obtained by substituting L' and X1 into the expression (12). Incidentally, when the molten-bath level of the molten steel is higher than H0, the displacement L is calculated as a negative value.

Assuming now that the displacement L of the molten-bath level of the molten steel changes from L1 to L2, then phase differences X1 and X2 in the respective displacements are given by the following expressions:

$$X1=((2L1+L')\times f1)/(V\times\Delta f) \quad (13)$$

$$X2=((2L2+L')\times f1)/(V\times\Delta f) \quad (14)$$

in which the phase difference change ΔX at this time is given by the following expression:

$$\Delta X = X2 - X1 \quad (15)$$
$$= (2(L2 - L1) \times f1)/(V \times \Delta f)$$
$$= 2\Delta L \times f1/(V \times \Delta f)$$

in which ΔL=L2−L1.

Because the relation between the phase difference change ΔX and the change difference ΔL is obtained as described above, ΔL can be calculated on the basis of ΔX. Further, the displacement L from the reference level and the molten-bath level of the molten steel can be calculated if ΔL is given.

In the following, discussion will be made while the specific numerical values described preliminarily are substituted.

(1) The number of stages in the shift register in each pseudo-random signal generator is selected to be seven.

$P=2^n-1=127$.

(2) Clock Frequency f1=1500.001 MHz f2=1500.000 MHz (3) The displacement ΔL is selected to be 1 mm.

When the aforementioned values are substituted into the expression (15), the phase difference change ΔX is given as follows.

$$\Delta X = (2\Delta L \times f1)/(V \times f1)$$
$$= 2 \times 1 \times 10^{-3} \times 1500 \times 10^{8}/(3 \times 10^{8} \times 1 \times 10^{3})$$
$$= 0.00001 \text{ (sec)}$$
$$= 10 \times 10^{-6} \text{ (sec)}$$

The signal propagation time ΔX' per mm is generally as follows.

$$\Delta X' = 2L/V$$
$$= (2 \times 1 \times 10^{-3})/(3 \times 10^{8})$$
$$= 6.7 \times 10^{-12} \text{ (sec)}$$

$$\Delta X/\Delta X' = 10\times10^{-6}/(6.7\times10^{-12}) = 1.5\times10^{6}$$

Accordingly, the signal propagation time is delayed by about 1,500,000 times, so that signal processing can be performed easily and accurately.

Figure 11:
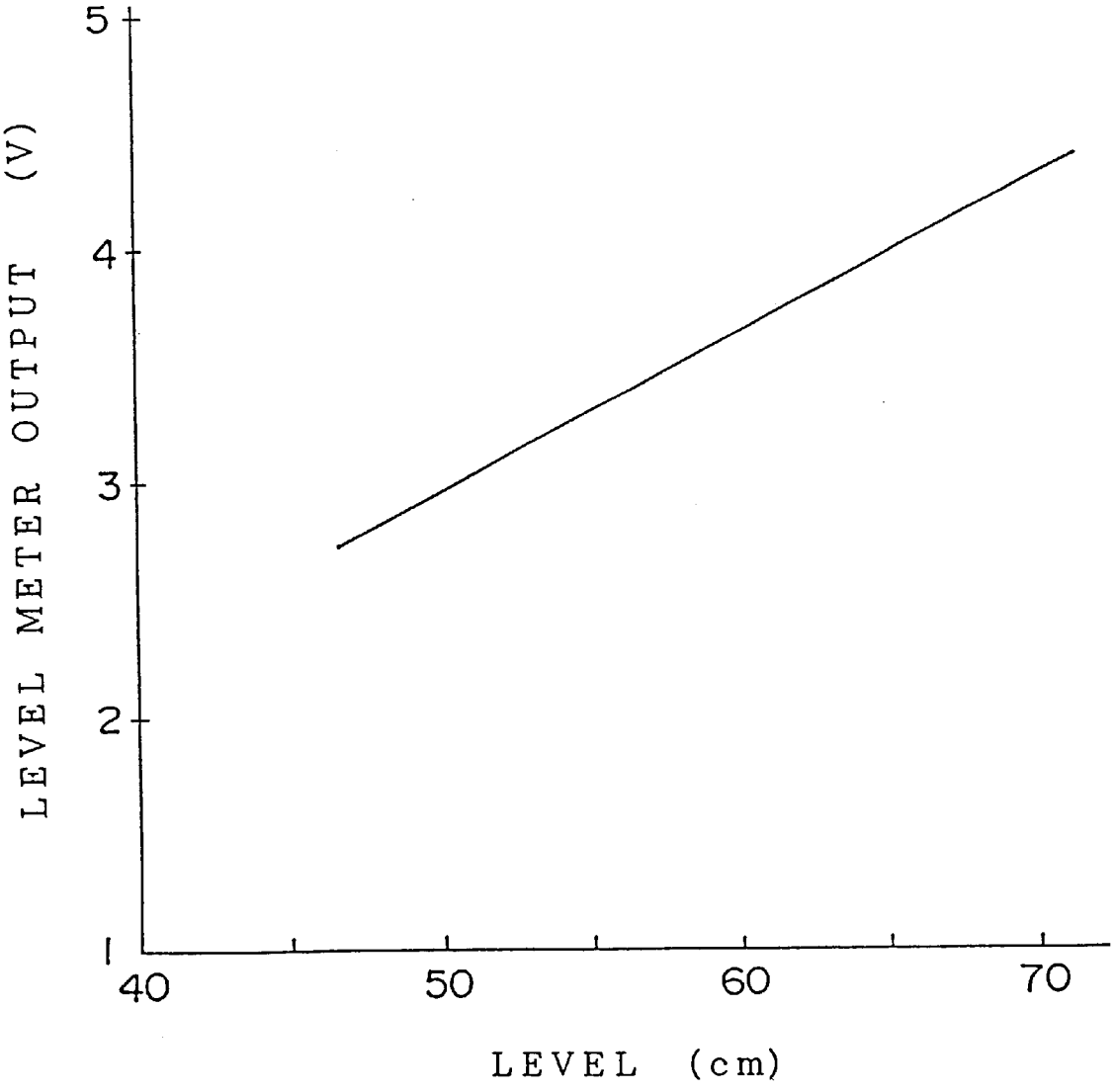
FIG. 11 is a characteristic graph showing an example of the measurement value of the electrode type level meter depicted in FIG. 1.

FIG. 11 is a characteristic graph showing the measurement result of the electrode type level meter 3 depicted in FIG. 1. In the graph, the molten-bath level of the molten steel is taken as the abscissa and the voltage indicating the measured value of the molten-bath level of the molten steel is taken as the ordinate. The measurement condition in this occasion is f=1500 MHz, Δf=1 KHz and 7 stages in the shift register in each pseudo-random signal generator. According to an experiment, the level or the distance from the reference position could be processed easily and speedily by fetching the phase difference X in a computer and performing an arithmetic operation.

Incidentally, in this embodiment, a metal having a melting point higher than the molten metal may be used as the electrodes 1 and 2 or the electrodes 1 and 2 may be gradually put into the molten metal automatically. If the same material as the molten metal is used as the electrodes, there is no influence on the components of the molten metal even if the electrodes are melted.

Although the contents of the electrode type level meter 3 have become apparent from the above description, the electrode type level meter 3 will be described again with reference to FIG. 1. In the casting controller 4, also a detection signal of the electromagnetic induction type level meter 13 is supplied. At the time point when the molten-bath level of the molten steel in the mold ascends and the output of the electromagnetic induction type level meter 13 is obtained (at the time point when the molten-bath level of the molten steel reaches within a measurement span), the output-distance characteristic of the electromagnetic induction type level meter 13 is obtained and calibrated on the basis of the measurement result of the electrode type level meter 3. Thereafter, the measured value of the molten-bath level of the molten steel in the mold is calculated on the basis of the calibrated output of the electromagnetic induction type level meter 13.

Figure 12:
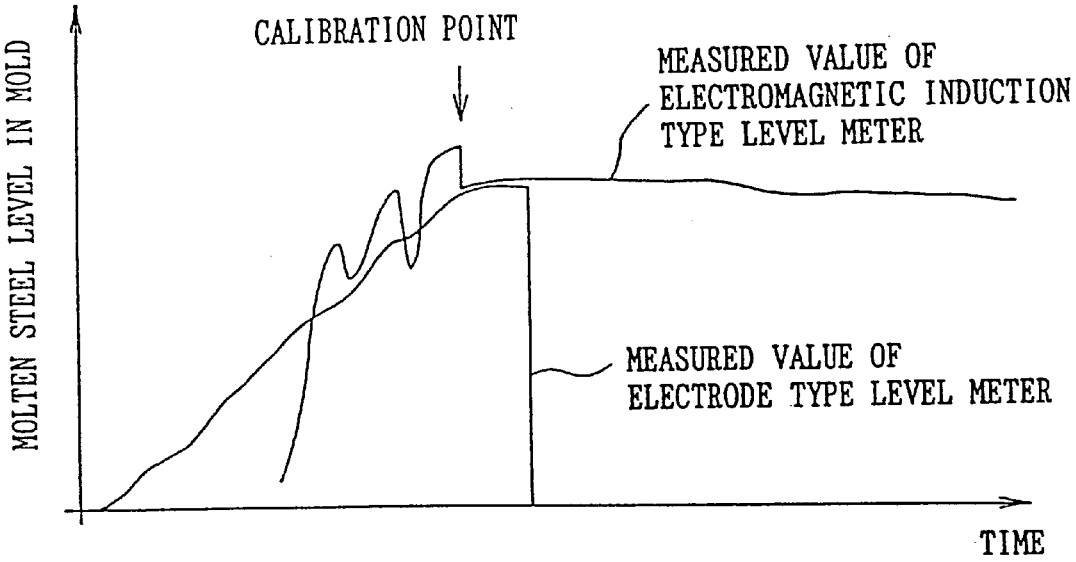
FIG. 12 is a characteristic graph showing the measurement values of the electrode type level meter and the electromagnetic induction type level meter in the embodiment of FIG. 1.

FIG. 12 is a graph showing continuously measured values of the molten-bath level of the molten steel in the mold by the electrode type level meter 3 according to this embodiment after the start of casting (after the start of steel melting), and measured values by the electromagnetic induction type level meter 13. The measured value by the electrode type level meter 3 and the measured value by the electromagnetic induction type level meter 13 are not coincident with each other initially, but the two measured values become coincident with each other from the time point when the measured value by the electromagnetic induction type level meter 13 is calibrated on the basis of the measured value by the electrode type level meter 3. Thereafter, the electrodes 1 and 2 are melted to thereby make the measurement by the electrode type level meter 3 impossible. Because the measured value by the electromagnetic induction type level meter 13 becomes accurate by calibration, the measured value by the electromagnetic induction type level meter 13 is used for steady-state controlling of the molten-bath level of the molten steel.

Further, in the casting controller 4, control signals are sent out to the drawing-out rate controller 5 and the nozzle opening adjuster 6 respectively correspondingly to the molten-bath level of the molten steel measured in the mold by the electrode type level meter 3 and the molten-bath level ascending rate. The drawing-out rate controller 5 controls the rotational velocity of the drawing-out roll 14 on the basis of the control signal to thereby control the drawing-out rate. Further, the nozzle opening adjuster 6 controls the position of the stopper 15 to thereby adjust the opening of the nozzle 9. Various methods may be considered as the method of controlling the molten-bath level of the molten steel. In this embodiment, at the time of the start of the casting operation, the position of the stopper 15 is controlled to adjust the opening of the nozzle 9 to a predetermined opening, and then injection of molten steel is started. At the time point when the molten-bath level of the molten steel in the mold reaches a predetermined level, the drawing-out roll 14 is driven to start drawing-out. Further, after the start of drawing-out, the adjustment of the opening of the nozzle 9 and the drawing-out rate were controlled so that the molten-bath level ascending rate of the molten steel in the mold decreased gradually and that the molten-bath level of the molten steel was converged into a predetermined value.

Embodiment 2

Figure 13:
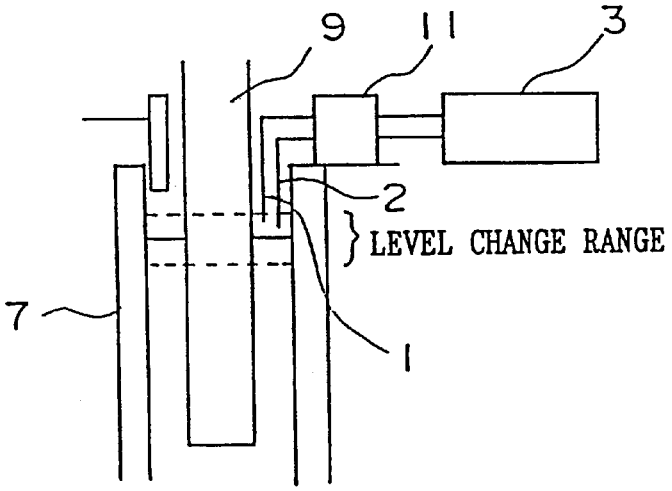
FIG. 13 is a diagram showing a continuous-casting operation controlling apparatus according to another embodiment of the present invention.

FIG. 13 is a diagram showing a continuous-casting operation controlling apparatus according to another embodiment of the present invention. In FIG. 13, an embodiment of detection of overflowing is illustrated. In a real operation, respective ends of the electrodes 1 and 2 are set in a position higher by tens of millimeters than the upper limit of the change of the molten-bath surface of the molten steel in the mold in a steady-state operation so that the drawing-out rate and the nozzle opening are adjusted by the casting controller 4 when a signal is detected by the electrode type level meter 3. In this embodiment, in order do check the effect, respective end portions of the electrodes 1 and 2 were set to be near the upper limit of the change of the molten-bath level of the molten steel in the mold in a steady-state operation so that the output of the electrode type level meter 3 was observed.

Figure 14:
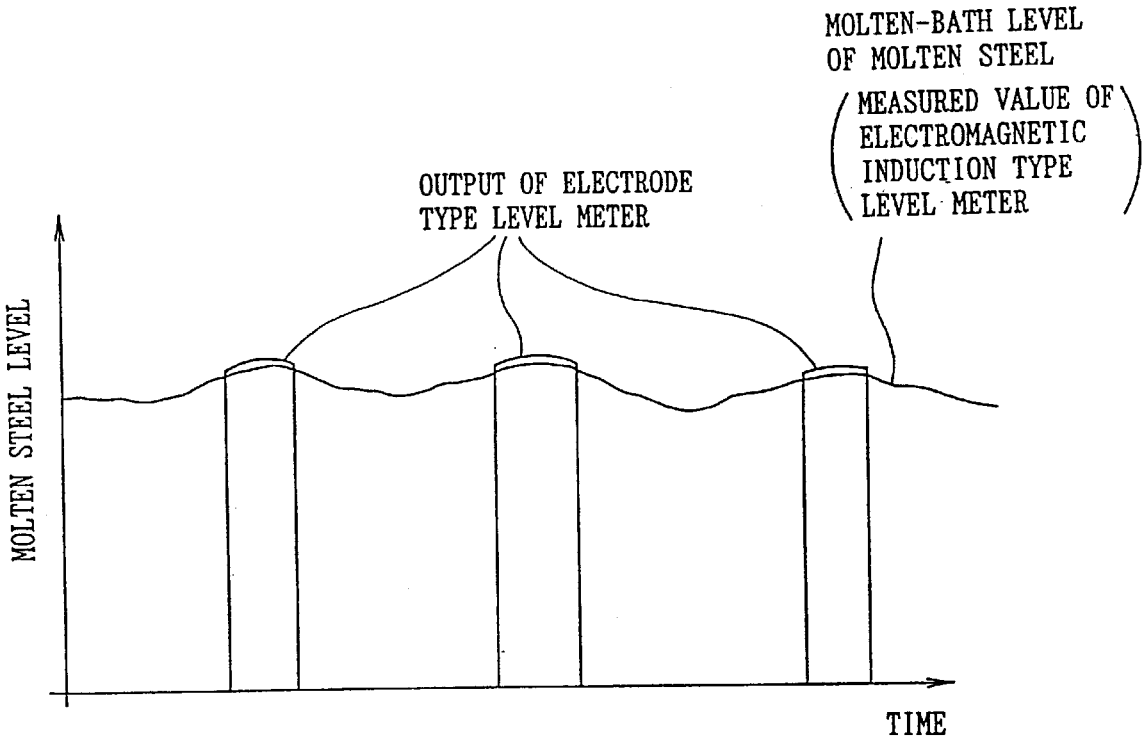
FIG. 14 is a characteristic graph showing the measurement values of the electrode type level meter and the electromagnetic induction type level meter in the embodiment of FIG. 13.

FIG. 14 is a diagram showing the result of the observation. The electrodes are brought into contact with the surface of the molten steel by the change of the molten-bath surface of the molten steel in a steady-state operation, so that measured values are obtained intermittently. When the electrodes 1 and 2 were set in a position higher than the molten-bath level of the molten steel, it was confirmed that the increase of the molten-bath level of the molten steel was detected to make it possible to prevent the molten steel from overflowing even in the case where the molten-bath level of the molten steel in the mold ascended abnormally because of a failure, or the like, of the electromagnetic induction type level meter 14.

Although this embodiment shows the case where a material with a predetermined length is used as each of the electrodes 1 and 2, long rods may be used as the electrodes 1 and 2 so that not only the measurement of the molten-bath level of the molten steel at the time of molten-bath level ascending but also the continuous or intermittent measurement of the molten-bath level of the molten steel in a steady-state are performed by inserting the electrode rods continuously or intermittently correspondingly to the immersion of the electrodes into the molten steel and the consumption of the electrodes.

Further, the measured value by the electromagnetic induction type level meter 13 is calibrated on the basis of the measured value of the molten-bath level of the molten steel measured continuously or intermittently by the electrode type level meter 3 so that the molten-bath level of the molten steel in a steady-state operation can be measured accurately as the absolute value by the electromagnetic induction type level meter. Particularly, when the temperature at the time of molten-bath level ascending is different from the temperature in a steady-state operation, temperature drift can be corrected appropriately.

Embodiment 3

In a continuous casting equipment, especially in a mold having a small sectional area such as a billet, the ascending rate of the molten-bath level of the molten steel is high. Accordingly, if metal rods are used as the electrodes, the electrodes may exist continuously up to the lower portion of the mold even at the time of the start of drawing-out because the time required for melting the electrodes in the molten steel is long. As a result, the electrodes are caught in the solidified shell at the time of the start of drawing-out and the electrodes are pulled out from the electrode holder with the start of drawing-out so that it may become impossible to perform measurement. As a countermeasure, there is considered a method in which the electrodes are thinned to adjust the time requited for melting the electrodes. In such a case, however, it is necessary to thin the electrodes extremely, so that strength sufficient to set and hold the electrodes cannot be obtained. In a further embodiment of the present invention, therefore, a hollow SUS pipe with an outer diameter of 3.0 mm, an inner diameter of 2.0 mm and a thickness of 0.5 mm was used as each of the two electrodes inserted into the mold of a small sectional area in continuous casting equipment.

As a result, the time required for melting of the electrodes in the molten steel was shortened. The immersing portions of the electrodes were melted in the molten steel successively following the ascending of the molten-bath level of the molten steel in the mold, so that there was no such a situation that the electrodes exist continuously up to the lower portion of the mold at the time of the start of drawing-out. Accordingly, there was avoided such a situation that the electrodes were caught in the shell and dropped out of the electrode holder to thereby make measurement impossible. Further, because the thickness of the electrode pipe was adjusted optimally as described above, the electrodes existed in a portion 10 mm–20 mm under than the molten-bath level at the time of the ascending of the molten-bath level so that there could be avoided such a situation that the contact between the molten steel and the electrodes was broken off to make measurement impossible even in the case where the molten-bath level was fluctuated at the time of the ascending of the molten steel. Accordingly, the molten-bath level of the molten steel could be measured and controlled continuously. Furthermore, by providing the electrodes as pipes, the time taken for the melting of the electrodes could be adjusted while the strength of the electrodes was kept.

Incidentally, members such as electrically conductive (carbon-containing) plastics, or the like, other than the aforementioned metal pipes, may be used as the electrodes so long as the members have suitable bending stiffness and the melting rate of the members matches the ascending rate of the molten-bath level of the molten steel.

Further, the aforementioned embodiments 2 and 3 are similarly applied to an embodiment which will be described later.

Embodiment 4

Figure 15:
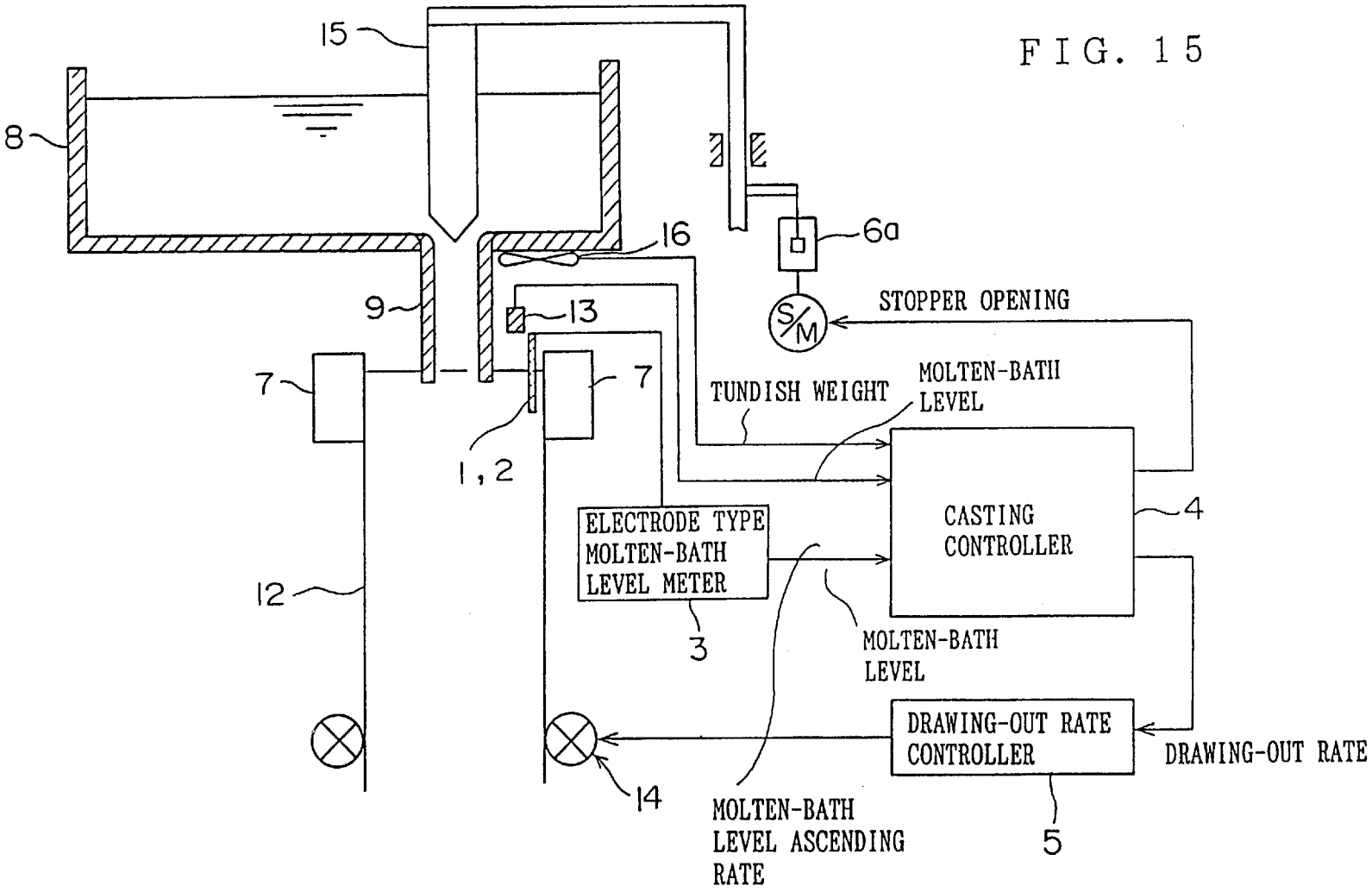
FIG. 15 is a block diagram showing the configuration of a continuous-casting controlling apparatus according to a further embodiment of the present invention and related equipment.
Figure 16:
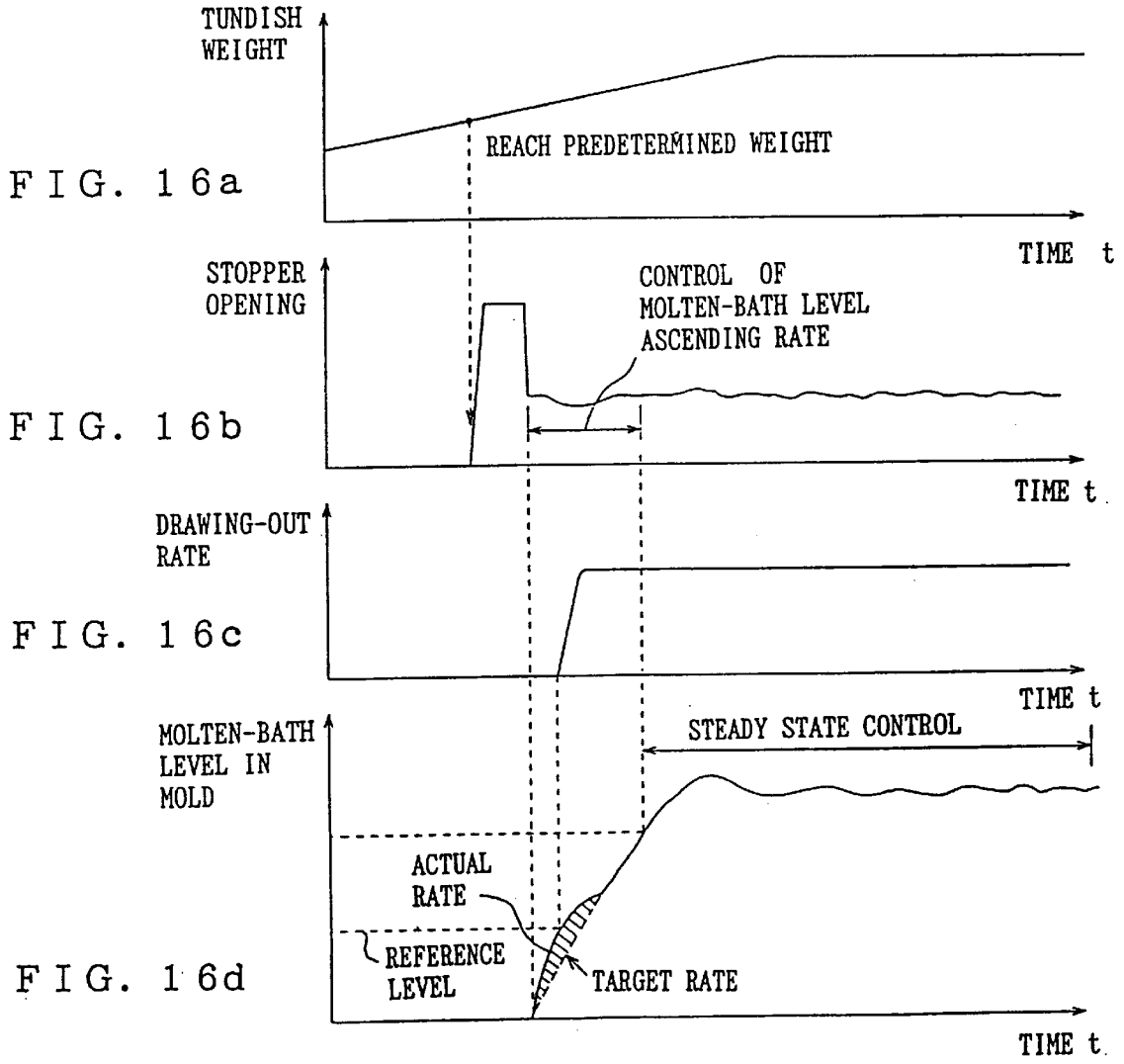
FIGS. 16(*a*)–16(*d*) are a timing chart of continuous-casting control depicted in FIG. 15.

FIG. 15 is a block diagram showing the configuration of a continuous-casting operation controlling apparatus according to a further embodiment of the present invention and related equipment. FIG. 16 is a timing chart showing the control state thereof. This embodiment is adapted to the case where the capacity of the mold is small as in the case of billet continuous casting, and the time required for the molten-bath level to reach a steady-state value is short (for example, 10 to 20 sec). In the control apparatus of FIG. 15, molten steel is injected into a tundish 8 from a ladle. When the weight of the molten steel detected by a tundish weighing meter 16 provided in the tundish 8 reaches a predetermined value (see (*a*) of FIG. 16), an instruction to full-open the opening of the stopper is outputted from the casting controller 4 to thereby drive a stepping cylinder 6*a*. The stopper 15 is full-opened by the drive of the stepping cylinder 6*a* (see (*b*) of FIG. 16), so that the molten steel begins to be injected into the mold 7. When a predetermined time is passed after the injection, an instruction to close the stopper 15 up to a predetermined opening is issued from the casting controller 4, so that the stopper 15 is closed up to the predetermined opening (see (*b*) of FIG. 16).

At this point of time, the molten-bath level is measured continuously by using the electrode type level meter 3 and the molten-bath level ascending rate of the molten steel is calculated every predetermined period on the basis of the change of the molten-bath level. The actually measured and calculated value of the molten-bath level ascending rate is inputted into the casting controller 4 and compared with the optimum target molten-bath level ascending rate inputted into the casting controller 4 in advance and provided correspondingly to the billet diameter so that no inclusion is caught in operation. Further, to make the deviation of the actually measured and calculated value of the molten-bath level ascending rate for the target value of the molten-bath level ascending rate be zero, the value for correction of the opening of the stopper is outputted from the casting controller 4, for example, by means of PI (proportion+integration) control, so that the opening of the stopper 15 is shifted to a predetermined opening (see (*b*) and (*d*) of FIG. 16).

Incidentally, in this embodiment, a metal having a melting point higher than the molten metal may be used for each of the electrodes, or the electrodes may be arranged so as to be brought into the molten metal gradually automatically.

Embodiment 5

Figure 17:
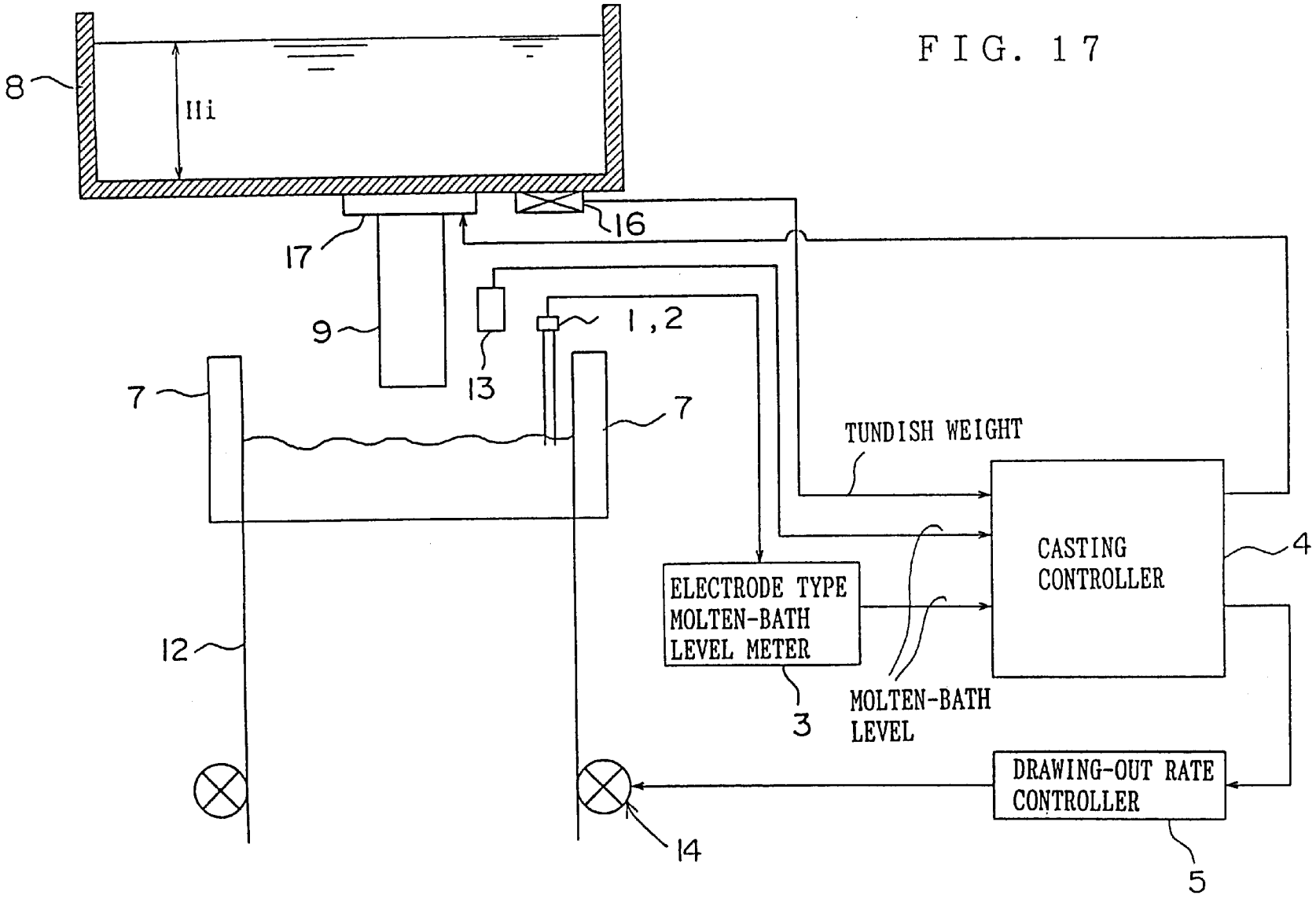
FIG. 17 is a block diagram showing the configuration of an automatic start controlling apparatus in continuous casting according to a further embodiment of the present invention and related equipment.

FIG. 17 is a block diagram showing the configuration of a continuous-casting operation controlling apparatus according to a further embodiment of the present invention and related equipment. FIG. 18 is a timing chart showing the control state thereof. This embodiment is adapted to the case where a tundish is re-used as in the case of slab continuous casting or to the case where the capacity of the mold is relatively large so that the time required to reach the molten-bath level is long (for example, not smaller than 1 minute). In FIG. 17, the same reference numerals as those used in the apparatus of FIG. 15 refer to the same or equivalent parts as those in the latter. Accordingly, the description thereof will be omitted.

In the apparatus of FIG. 17, molten steel is injected from a ladle into the tundish 8. When the weight detected by the tundish weighing meter 16 reaches a predetermined value (see (*a*) of FIG. 18), an instruction to open the sliding nozzle 17 up to an initial opening is outputted from the casting controller 4. Incidentally, before reception of this instruction, the sliding nozzle 17 is made to vibrate in the neighborhood of the closed position in order to prevent the choking of the nozzle. Upon reception of the instruction, the sliding nozzle 17 is opened on the basis of the instruction so that the molten steel begins to be injected into the mold 7.

At this point of time, the molten-bath level is measured continuously by using the electrode type level meter 3 and the measurement result thereof is inputted into the casting controller 4. The casting controller 4 first calculates the actual discharge quantity on the basis of the values in the previous and current arithmetic operation period by the following expression (16):

$$Q_i = \frac{M_W \times M_T \times \rho \times (M_{L(i)} - M_{L(i-1)})}{T_C} \tag{16}$$

in which $Q_i$: actual discharge quantity (g/sec) in the current period $M_W$: mold width (mm)

$M_T$: mold thickness (mm)

$\rho$: molten steel density (g/mm$^3$)

$M_{L(i)}$: molten-bath level (mm) in the current period $M_{L(i-1)}$: molten-bath level (mm) in the preceding period $T_C$: arithmetic operation period (sec)

By using $Q_i$ given by the expression (16), the actual nozzle gain is calculated by the following expression (17):

$$\beta_i = \frac{Q_i}{A_{T(i-1)} \times \rho \times \sqrt{2gH_{i-1}}} \tag{17}$$

in which $\beta_i$: actual nozzle gain in the current period $A_{T(i-1)}$: target value (mm$^2$) of the opening area of the sliding nozzle in the preceding period g: acceleration of gravity (mm/s$^2$)

$H_{i-1}$: molten steel head (mm) in the preceding period

Incidentally, $Q_i$ and $\rho$ are the same as those in the description of the expression (16). The molten steel head $H_{i-1}$ is obtained on the basis of the weight detected by the tundish weighing meter 16 in the timing of measuring the molten-bath level $M_{L(i-1)}$. Accordingly, the molten steel head measuring means according to the present invention is constituted by the tundish weighing meter 16 and the casting controller 4 in this embodiment.

The target discharge quantity to be injected up to the remaining mold height in the time left up to the target injection time is calculated on the basis of the actual value of the molten-bath level by the following expression (18):

$$Q_{Ti} = \frac{M_W \times M_T \times \rho \times (M_D - M_{L(i)})}{T_M - (i \times T_C)} \tag{18}$$

in which $Q_{Ti}$: target discharge quantity [g/sec] in the current period $M_D$: mold height (mm)

$T_M$: target injection time (sec)

$M_W$, $M_T$, $\rho$, $M_{L(i)}$ and $T_C$ are the same as those in the description of the expression (16).

On the basis of $\beta_i$ obtained by the expression (17) and $Q_{Ti}$ obtained by the expression (18), the target value of the opening area of the sliding nozzle is calculated by the following expression (19):

$$A_{Ti} = \frac{Q_{Ti}}{\beta_i \times \rho \times \sqrt{2gH_i}} \quad (19)$$

in which $A_{Ti}$: target value ($mm^2$) of the opening area of the sliding nozzle in the current period $H_i$: molten steel head (mm) in the current period Incidentally, $Q_{Ti}$, $\beta_i$, $\rho$ and g are the same as those in the description of the expressions (16) and (18).

Feedback control is performed by adusting the sliding nozzle operating quantity corresponding to the target value $A_{Ti}$ of the opening area of the sliding nozzle 17 in the current period as obtained by estimation of the nozzle gain $\beta_i$ on the basis of the aforementioned calculation. The aforementioned control is performed in each arithmetic operation period of the casting controller 4 until the molten-bath level reaches the steady-state level in which the steady-state level control of the steady-state operation is performed (see (*c*) of FIG. 18). Thereafter, steady-state level control is performed on the basis of the value of the molten-bath level measured by the electromagnetic induction type (eddy current type) level meter 13. Incidentally, before the steady-state level control (at the point of time when the level reaches the reference level), an instruction to draw out the dummy bar is issued from the drawing-out rate controller 5 so that drawing-out of the dummy bar is started (see (*d*) of FIG. 18).

We claim:

1. A continuous-casting operation controlling method comprising the steps of:

(a) introducing molten steel into a mold;

(b) continuously measuring a molten-bath level of the molten steel in the mold by inserting a pair of electrodes of an electrode molten-bath level meter into the molten steel in the mold, supplying a pseudo-random signal to one of the electrodes and receiving, from the other of the electrodes, the signal delivered through the molten steel;

(c) obtaining a molten-bath level ascending rate on the basis of a change of said molten-bath level during a period after the molten steel starts being introduced into the mold until said molten-bath level reaches a reference level which is lower than a steady-state molten-bath level for a steady-state operation, adjusting a flow rate of molten steel discharged from a tundish into the mold on the basis of said molten-bath level ascending rate and controlling said molten-bath level ascending rate of molten steel in the mold in order to target ascending rate;

(d) starting drawing-out of casting steel from said mold when said molten-bath level reaches said reference level;

(e) obtaining a molten-bath level ascending rate on the basis of a change of the molten-bath level during a period after the drawing-out of casting steel is started until the molten-bath level reaches the steady-state molten bath level for the steady-state operation, adjusting a rate of drawing-out of casting steel and the flow rate of molten steel discharged from the tundish into the mold on the basis of said molten-bath level and said molten-bath level ascending rate and controlling said molten-bath level ascending rate of molten steel in the mold in order to obtain the target ascending rate;

(f) calibrating a measured value of an electromagnetic induction level meter on the basis of the molten-bath level of molten steel in the mold measured by the electrode molten-bath level meter; and (g) starting the steady-state operation when the molten-bath level reaches the steady-state molten-bath level and thereafter controlling said molten-bath level on the basis of the measured value of said electromagnetic induction level meter in place of said electrode molten-bath level meter.

2. A continuous-casting operation controlling method according to claim 1, further comprising the steps of:

holding the electrodes of said electrode molten-bath level meter above the molten-bath level of molten steel in the mold after starting steady-state operation, to detect contact between the molten steel and the electrodes; and adjusting an opening of a tundish nozzle on the basis of the detection of said contact to prevent the molten steel from overflowing out of the mold.

3. A continuous-casting operation controlling method according to claim 1, wherein a member capable of melting at a rate nearly equal to the molten-bath level ascending rate of molten steel at the time of the start of casting is used as each of the electrodes of said electrode molten-bath level meter.

4. A continuous-casting operation controlling method comprising the steps of:

(a) introducing molten steel in a mold;

(b) continuously measuring a molten-bath level of the molten steel in the mold by inserting a pair of electrodes of an electrode molten-bath level meter into the molten steel in the mold, supplying a pseudo-random signal from one of the electrodes and receiving the signal delivered through the molten steel at the other of the electrodes;

(c) repeating, in predetermined arithmetic operation cycles during a period after the molten steel starts being introduced into the mold until said molten-bath level reaches a steady-state molten-bath level for a steady-state operation, a series of the following steps (c1–c5) of;

(c1) measuring a head of molten steel in a tundish;

(c2) calculating an estimated nozzle gain value on the basis of the molten-bath level, the head of molten steel and an opening of a stopper or sliding nozzle, (c3) calculating a target discharged flow rate of molten steel on the basis of the molten-bath level to satisfy a target injection time which is set in advance, (c4) calculating the opening of the stopper or sliding nozzle on the basis of the estimated nozzle gain value and the target discharged flow rate, and (c5) adjusting a flow rate of molten steel discharged from the tundish by operating the opening of the stopper or sliding nozzle on the basis of the calculated opening, (d) starting drawing out of casting steel from the mold when said molten-bath level reaches a reference level which is lower than said steady-state molten-bath level;

(e) calibrating a measured value of an electromagnetic induction level meter on the basis of the molten-bath level of molten steel in the mold measured by the electrode molten-bath level meter; and (f) starting the steady-state operation when the molten-bath level reaches the steady-state molten-bath level and thereafter controlling said molten-bath level on the basis of the measured value of said electromagnetic induction level meter in place of said electrode molten-bath level meter.

5. A continuous-casting operation controlling method according to claim 4, further comprising the steps of:

holding the electrodes of said electrode molten-bath level meter above the molten-bath level of molten steel in the mold after starting steady-state operation to detect contact between the molten steel and the electrodes; and adjusting an opening of a tundish nozzle on the basis of the detection of said contact to prevent the molten steel from overflowing out of the mold.

6. A continuous-casting operation controlling method according to claim 4, wherein a member capable of melting at a rate nearly equal to the molten-bath level ascending rate of molten steel at the time of the start of casting is used as each of the electrodes of said electrode molten-bath level meter.

7. A continuous-casting operation controlling apparatus comprising:

an electrode molten-bath level meter including a pair of electrodes to be inserted into molten steel in a mold, means for supplying a first pseudo-random signal to one of said electrodes, means for calculating a first multiplication value by multiplying said first pseudo-random signal by a second pseudo-random signal which has a pattern the same as said first pseudo-random signal but which is slightly different in frequency from said first pseudo-random signal, means for calculating a second multiplication value by multiplying said second pseudo-random signal by a signal received from the other of said electrodes, means for integrating said first and second multiplication values respectively, means for measuring a molten-bath level on the basis of a time difference between maximum correlation values generated in time-series patterns of the integrated values respectively, and means for calculating a molten-bath level ascending rate on the basis of a change of the molten-bath level; and a casting controller including means for adjusting a flow rate of molten steel discharged from a tundish into the mold on the basis of said molten-bath level ascending rate to control said molten-bath level ascending rate of molten steel in the mold in order to make it a target ascending rate during a period after the molten steel starts being introduced into the mold until said molten-bath level reaches a reference level which is lower than a steady-state molten-bath level for a steady-state operation, means for starting drawing-out of casting steel from the mold when said molten-bath level reaches the reference level, means for respectively adjusting a rate of drawing-out and the flow rate of molten steel discharged from the tundish into the mold on the basis of said molten-bath level and said molten-bath level ascending rate to control said molten-bath level ascending rate of molten steel in the mold in order to make it the target ascending rate during a period after the drawing-out of casting steel is started until the molten-bath level reaches the steady-state molten-bath level for the steady state operation, means for starting the steady-state operation when the molten-bath level reaches the steady-state molten-bath level; and means for controlling said molten-bath level on the basis of the measured value of an electromagnetic induction level meter in place of said electrode molten-bath level meter.

8. A continuous-casting operation controlling apparatus comprising:

an electrode molten-bath level meter including a pair of electrodes to be inserted into molten steel in a mold, means for supplying a first pseudo-random signal to one of said electrodes, means for calculating a first multiplication value by multiplying said first pseudo-random signal by a second pseudo-random signal which has a pattern the same as said first pseudo-random signal but which is slightly different in frequency from said first pseudo-random signal, means for calculating a second multiplication value by multiplying said second pseudo-random signal by a signal received from the other of said electrodes, means for integrating said first and second multiplication values respectively, and means for measuring a molten-bath level on the basis of a time difference between maximum correlation values generated in time-series patterns of the integrated values respectively;

means for measuring a head of the molten steel in a tundish; and a casting controller including means for calculating an estimated nozzle gain value on the basis of the molten-bath level, the head of molten steel in the tundish and an opening of a topper or sliding nozzle controlling flow of molten steel from the tundish to the mold, means for calculating a target discharged flow rate of the molten steel on the basis of the molten-bath level to satisfy a target introduction time which is set in advance, means for calculating the opening of the stopper or sliding nozzle on the basis of the estimated nozzle gain value and the target discharged flow rate, means for adjusting a flow rate of the molten steel discharged from the tundish by operating the opening of the stopper or sliding nozzle on the basis of the calculated opening, means for repeating the above-mentioned processing at every operation cycle, means for starting drawing-out of casting steel when the molten-bath level for the steady-state operation, and means for starting a steady-state operation when the molten-bath level reaches a steady-state molten-bath level, and for thereafter controlling said molten-bath level on the basis of the measured value of an electromagnetic induction level meter in place of said electrode molten-bath level meter.

* * * * *